US010309701B2

(12) United States Patent
Morimoto et al.

(10) Patent No.: US 10,309,701 B2
(45) Date of Patent: Jun. 4, 2019

(54) HEAT EXCHANGER AND AIR CONDITIONER

(71) Applicant: DAIKIN INDUSTRIES, LTD., Osaka-shi, Osaka (JP)

(72) Inventors: Kousuke Morimoto, Osaka (JP); Yoshio Oritani, Osaka (JP); Masanori Jindou, Osaka (JP); Tomohiko Sakamaki, Osaka (JP); Takuya Kazusa, Osaka (JP); Junichi Hamadate, Osaka (JP)

(73) Assignee: DAIKIN INDUSTRIES, LTD., Osaka-Shi, Osaka (JP)

( * ) Notice: Subject to any disclaimer, the term of this patent is extended or adjusted under 35 U.S.C. 154(b) by 204 days.

(21) Appl. No.: 14/916,736

(22) PCT Filed: Sep. 5, 2014

(86) PCT No.: PCT/JP2014/004579
§ 371 (c)(1),
(2) Date: Mar. 4, 2016

(87) PCT Pub. No.: WO2015/037214
PCT Pub. Date: Mar. 19, 2015

(65) Prior Publication Data

US 2016/0216014 A1 Jul. 28, 2016

(30) Foreign Application Priority Data

Sep. 11, 2013 (JP) ..... 2013-188734

(51) Int. Cl.
*F28F 1/02* (2006.01)
*F25B 39/00* (2006.01)
(Continued)

(52) U.S. Cl.
CPC ..... *F25B 39/00* (2013.01); *F28D 1/05391* (2013.01); *F28F 1/022* (2013.01);
(Continued)

(58) Field of Classification Search
CPC .. F25B 39/028; F25B 39/022; F28D 1/05383; F28D 1/05391; F28F 1/022; F28F 1/045;
(Continued)

(56) References Cited

U.S. PATENT DOCUMENTS 5,529,116 A * 6/1996 Sasaki ..... F28D 1/0417 123/41.51
2007/0131393 A1* 6/2007 Sasaki ..... F28D 1/05391 165/110

(Continued)

FOREIGN PATENT DOCUMENTS

CN 101821577 A 9/2010
JP 03-77167 U 8/1991

(Continued)

OTHER PUBLICATIONS

International Search Report issued in PCT/JP2014/004579 dated Dec. 9, 2014.

*Primary Examiner* — Joseph F Trpisovsky
(74) *Attorney, Agent, or Firm* — Birch, Stewart, Kolasch & Birch, LLP

(57) ABSTRACT

In two heat exchange regions connected together in series when an outdoor heat exchanger functions as an evaporator, a downstream one of the heat exchange regions has heat exchange sections not less than heat exchange sections of an upstream one of the heat exchange regions, and a most downstream one of the heat exchange regions has more heat exchange sections than a most upstream one of the heat exchange regions.

10 Claims, 11 Drawing Sheets

(51) Int. Cl.

| | |
|---|---|
| ***F28F 9/02*** | (2006.01) |
| ***F28F 27/02*** | (2006.01) |
| ***F28D 1/053*** | (2006.01) |
| ***F28F 1/32*** | (2006.01) |
| *F25B 13/00* | (2006.01) |
| *F25B 39/02* | (2006.01) |

(52) U.S. Cl.
CPC ..... *F28F 1/325* (2013.01); *F28F 9/0204* (2013.01); *F28F 9/0265* (2013.01); *F28F 9/0275* (2013.01); *F28F 27/02* (2013.01); *F25B 13/00* (2013.01); *F25B 39/028* (2013.01); *F28F 2275/04* (2013.01)

(58) Field of Classification Search
CPC ..... F28F 1/325; F28F 9/0204; F28F 9/0265; F28F 9/0275; F28F 9/0278; F28F 27/02; F28F 2275/04
USPC ..... 62/525, 524, 526
See application file for complete search history.

(56) References Cited

U.S. PATENT DOCUMENTS

| | | | | |
|---|---|---|---|---|
| 2009/0120627 | A1* | 5/2009 | Beamer ..... | F28D 1/05375 165/174 |
| 2010/0206535 | A1 | 8/2010 | Munoz et al. | |

FOREIGN PATENT DOCUMENTS

| | | | |
|---|---|---|---|
| JP | 2002-195764 | A | 7/2002 |
| JP | 2009-092274 | A | 4/2009 |
| JP | 2013-137193 | A | 7/2013 |

* cited by examiner

HEAT EXCHANGER AND AIR CONDITIONER

TECHNICAL FIELD

The present invention relates to a heat exchanger which includes flat tubes and fins and allows a refrigerant and air to exchange heat, and an air conditioner.

BACKGROUND ART

There has been known a heat exchanger which allows a refrigerant and air to exchange heat and includes a plurality of vertically arranged flat tubes, fins joined to the flat tubes, and two header collection pipes, each of which is connected to an associated one of the ends of each of the flat tubes (see, e.g., Patent Document 1).

A heat exchanger disclosed by Patent Document 1 is divided into two vertically arranged heat exchange regions. Each of the two heat exchange regions is further divided into three vertically arranged heat exchange sections. The two heat exchange regions are connected in series when the heat exchanger functions as an evaporator, and a refrigerant flows from each of auxiliary heat exchange sections of a lower auxiliary heat exchange region to an associated one of principal heat exchange sections of an upper principal heat exchange region.

In each of the two header collection pipes, communicating spaces each communicating with the plurality of flat tubes are formed in a one-to-one relationship with the heat exchange sections. In the heat exchanger described above, a refrigerant that flowed into each of the communicating spaces is distributed into the plurality of vertically arranged flat tubes communicating with an associated one of the communicating spaces, and exchanges heat with the air while flowing through the flat tubes.

CITATION LIST

Patent Document

[Patent Document 1] Japanese Unexamined Patent Publication No. 2013-137193

SUMMARY OF THE INVENTION

Technical Problem

When the heat exchanger functions as an evaporator, a gas-liquid two-phase refrigerant flows into the communicating spaces corresponding to the heat exchange sections, and is distributed from each of the communicating spaces into the plurality of vertically arranged flat tubes. The refrigerant distributed into the plurality of flat tubes exchanges heat with the air to evaporate. Note that a liquid refrigerant has a higher density than a gas refrigerant. Thus, if the refrigerant is distributed from the communicating space into the plurality of vertically arranged flat tubes, the gas and liquid refrigerants are separated from each other by gravity, and thus a drift of the refrigerant tends to occur, that is, the liquid refrigerant flows mostly into the lower flat tubes, while the gas refrigerant flows mostly into the upper flat tubes. Further, when the heat exchanger functions as an evaporator, the refrigerant flowing into a downstream principal heat exchange region contains the gas refrigerant at a higher ratio than the refrigerant flowing into an upstream auxiliary heat exchange region. Thus, the drift of the refrigerant may occur more easily in the communicating space corresponding to the downstream principal heat exchange region than in the communicating space corresponding to the upstream auxiliary heat exchange region. Since the refrigerant having low wetness flows into an upper one of the heat exchange sections of the downstream heat exchange region, the refrigerant may possibly turn into a gas refrigerant while flowing through the flat tubes. A region through which an superheated gas refrigerant flows hardly functions as an evaporator. Thus, it may be impossible for the heat exchanger to exhibit sufficiently good performance if the region through which the superheated gas refrigerant flows is provided.

In view of the foregoing, it is therefore an object of the present invention to reduce, in a heat exchanger including a plurality of vertically arranged flat tubes and an air conditioner including the heat exchanger, a drift of a refrigerant flowing from a communicating space to the flat tubes, thereby allowing the heat exchanger to exhibit sufficiently good performance.

Solution to the Problem

A first aspect of the present disclosure is directed to a heat exchanger including: at least one heat exchanger unit (30) including a plurality of vertically arranged flat tubes (31), fins (32) joined to the flat tubes (31), a first header collection pipe (40) (340, 370) connected to one of ends of each of the flat tubes (31), and a second header collection pipe (70) (345, 380) connected to the other end of each of the flat tubes (31), the heat exchanger unit (30) being divided into a plurality of vertically arranged heat exchange regions (35, 37) (37, 135, 235) (335, 337, 365, 367), and the plurality of heat exchange regions (35, 37) (37, 135, 235) (335, 337, 365, 367) being connected in series when the heat exchanger functions as an evaporator, the heat exchanger allowing a refrigerant flowing through the flat tubes (31) and air to exchange heat. Each of the heat exchange regions (35, 37) (37, 135, 235) (335, 337, 365, 367) is further divided into a plurality of vertically arranged heat exchange sections. Communicating spaces each communicating with the plurality of flat tubes (31) are formed in each of the first and second header collection pipes (40, 70) (340, 345, 370, 380) in a one-to-one relationship with the heat exchange sections. In two of the heat exchange regions connected to each other when the heat exchanger functions as an evaporator, a downstream one (35) (135, 235) (335, 365, 367) of the heat exchange regions has the heat exchange sections not less than the heat exchange sections of an upstream one (37) (37, 235) (337, 365, 367) of the heat exchange regions, and a most downstream one (35) (135) (335) of the heat exchange regions has more heat exchange sections than a most upstream one (37) (337) of the heat exchange regions.

According to the first aspect of the present disclosure, a plurality of heat exchange regions (35, 37) (37, 135, 235) (335, 337, 365, 367) are connected in series when the heat exchanger functions as an evaporator. In this state, in two of the heat exchange regions connected to each other, a downstream one (35) (135, 235) (335, 365, 367) of the heat exchange regions has heat exchange sections not less than those of an upstream one (37) (37, 235) (337, 365, 367) of the heat exchange regions, and a most downstream one (35) (135) (335) of the heat exchange regions has more heat exchange sections than a most upstream one (37) (337) of the heat exchange regions. In this configuration, when the heat exchanger functions as an evaporator, the number of communicating spaces corresponding to the most downstream heat exchange region (35) (135) (335) increases, and thus the number of flat tubes (31) communicating with each of the communicating spaces decreases and the height of each of the communicating spaces decreases as compared with the case where the most downstream and most upstream heat exchange regions (35) (135) (335) and (37) (337) have the same number of heat exchange sections. A drift of the refrigerant occurs most easily in each of the communicating spaces corresponding to the most downstream heat exchange region (35) (135) (335) when the heat exchanger functions as an evaporator. However, if the height of each of the communicating spaces corresponding to the most downstream heat exchange region (35) (135) (335) decreases as described above, gas and liquid refrigerants are not separated easily, and the drift of the refrigerant does not occur easily in each of the communicating spaces corresponding to the most downstream heat exchange region (35) (135) (335).

A second aspect of the present disclosure is an embodiment of the first aspect of the present disclosure. In the second aspect, when the heat exchanger functions as an evaporator, the number of the heat exchange sections of each of the heat exchange regions (35, 37) (37, 135, 235) (335, 337, 365, 367) gradually increases from the most upstream heat exchange region (37) (337) toward the most downstream heat exchange region (35) (135) (335).

According to the second aspect, when the heat exchanger functions as an evaporator, the number of communicating spaces corresponding to each of the heat exchange regions (35, 37) (37, 135, 235) (335, 337, 365, 367) gradually increases from the most upstream heat exchange region (37) (337) toward the most downstream heat exchange region (35) (135) (335). Thus, the more downstream the heat exchange region is located, the shorter the communicating spaces corresponding to the heat exchange region become. This reduces the drift of the refrigerant in the communicating spaces, although which occurs more easily in the more downstream heat exchange region among a plurality of heat exchange regions (35, 37) (37, 135, 235) (335, 337, 365, 367) connected in series when the heat exchanger functions as an evaporator.

A third aspect of the present disclosure is an embodiment of the first or second aspect of the present disclosure. In the third aspect, in two of the heat exchange regions (35, 37) (135, 235) (335, 365) connected to each other when the heat exchanger functions as an evaporator, a downstream one of the heat exchange regions having more heat exchange sections than an upstream one, the number of the heat exchange sections of the downstream heat exchange region (35) (135) (335) is a multiple of the number of the heat exchange sections of the upstream heat exchange region (37) (235) (365).

The heat exchanger according to the third aspect of the present disclosure is configured such that in two heat exchange regions (35, 37) (135, 235) (335, 365), a downstream one (35) (135) (335) of which has more heat exchange sections than an upstream one (37) (235) (365) when the heat exchanger functions as an evaporator, the number of the heat exchange sections of the downstream heat exchange region (35) (135) (335) is a multiple of the number of the heat exchange sections of the upstream heat exchange region (37) (235) (365).

A fourth aspect of the present disclosure is an embodiment of the third aspect of the present disclosure. In the fourth aspect, between two of the heat exchange regions (35, 37) (135, 235) (335, 365) connected to each other when the heat exchanger functions as an evaporator, a downstream one of the heat exchange regions having more heat exchange sections than an upstream one, a branch pipe (110, 120, 130) is provided to connect each of the heat exchange sections of the upstream heat exchange region (37) (235) (365) to the plurality of mutually different heat exchange sections of the downstream heat exchange region (35) (135) (335).

According to the fourth aspect of the present disclosure, a branch pipe (110, 120, 130) is provided between two heat exchange regions (35, 37) (135, 235) (335, 365), a downstream one (35) (135) (335) of which has more heat exchange sections than an upstream one (37) (235) (365) when the heat exchanger functions as an evaporator. When the heat exchanger functions as an evaporator, a refrigerant that flowed through each of the heat exchange sections of the upstream heat exchange region (37) (235) (365) is distributed by the branch pipe (110, 120, 130) to flow into the plurality of heat exchange sections of the downstream heat exchange region (35) (135) (335).

A fifth aspect of the present disclosure is an embodiment of any one of the first to fourth aspects of the present disclosure. In the fifth aspect, the heat exchange section having the largest number of the flat tubes (31) is arranged at a lowest position in each of the heat exchange regions (35, 37) (37, 135, 235) (335, 337, 365, 367).

When the heat exchanger functions as an evaporator, a large amount of liquid refrigerant flows more easily into the lower heat exchange section in each of the heat exchange regions (35, 37) (37, 135, 235) (335, 337, 365, 367). On the other hand, the height of the communicating space increases as the number of flat tubes (31) communicating with the communicating space increases. Thus, when the outdoor heat exchanger (23) functions as an evaporator, the drift of the refrigerant occurs more easily in a communicating space communicating with a relatively large number of flat tubes (31) than in a communicating space communicating with a relatively small number of flat tubes (31).

Thus, according to the fifth aspect of the present disclosure, among the plurality of heat exchange sections of the heat exchange region (35, 37) (37, 135, 235) (335, 337, 365, 367) having different numbers of flat tubes (31), the heat exchange section having a larger number of flat tubes (31) and thus causing the drift of the refrigerant easily in the corresponding communicating space when the heat exchanger functions as an evaporator is arranged at a lower position where a large amount of liquid refrigerant flows more easily. As a result, the drift of the refrigerant is reduced because a large amount of liquid refrigerant flows into the communicating space corresponding to the heat exchange section where the drift of the refrigerant occurs easily when the heat exchanger functions as an evaporator.

A sixth aspect of the present disclosure is an embodiment of any one of the first to fifth aspects of the present disclosure. In the sixth aspect, the heat exchanger unit (30) includes a plurality of heat exchanger units (30), and all the heat exchange regions (35, 37) (37, 135, 235) (335, 337, 365, 367) of the plurality of heat exchanger units (30) are connected in series when the heat exchanger functions as an evaporator.

According to the sixth aspect of the present disclosure, a plurality of heat exchanger units are provided, and all the heat exchange regions of the plurality of heat exchanger units are connected in series when the heat exchanger functions as an evaporator.

A seventh aspect of the present disclosure is directed to an air conditioner (10) including a refrigerant circuit (20) including the heat exchanger (23) according to any one of the first to sixth aspects of the present disclosure. A refrigerant is circulated in the refrigerant circuit (20) to perform a refrigeration cycle.

According to the seventh aspect of the present disclosure, the heat exchanger (23) of any one of the first to sixth aspects of the present disclosure is connected to the refrigerant circuit (20). In the heat exchanger (23), a refrigerant circulating in the refrigerant circuit (20) exchanges heat with air while passing through the flat tubes (31).

Advantages of the Invention

According to the first to sixth aspects of the present disclosure, the heat exchanger is configured such that a downstream one (35) (135, 235) (335, 365, 367) of two heat exchange regions connected to each other when the heat exchanger functions as an evaporator has heat exchange sections not less than those of an upstream heat exchange region (37) (37, 235) (337, 365, 367), and a most downstream heat exchange region (35) (135) (335) has more heat exchange sections than a most upstream heat exchange region (37) (337). In this configuration, when the heat exchanger functions as an evaporator, the number of communicating spaces corresponding to the most downstream heat exchange region (35) (135) (335) increases, and thus the number of flat tubes (31) communicating with each of the communicating spaces decreases and the height of each of the communicating spaces decreases as compared with the case where the most downstream and most upstream heat exchange regions (35) (135) (335) and (37) (337) have the same number of heat exchange sections. A drift of a refrigerant occurs most easily in each of the communicating spaces corresponding to the most downstream heat exchange region (35) (135) (335) when the heat exchanger functions as an evaporator. However, if the height of each of the communicating spaces corresponding to the most downstream heat exchange region (35) (135) (335) decreases as described above, gas and liquid refrigerants are not separated easily, and the drift of the refrigerant does not occur easily in each of the communicating spaces corresponding to the most downstream heat exchange region (35) (135) (335). Thus, according to the first to sixth aspects of the present disclosure, the drift of the refrigerant is reducible in each of the communicating spaces corresponding to the most downstream heat exchange region (35) (135) (335) where the drift of the refrigerant occurs most easily when the heat exchanger functions as an evaporator. This allows the heat exchanger to exhibit sufficiently good performance.

When the heat exchanger functions as an evaporator and the amount of the refrigerant that flowed into the heat exchanger is small, the drift of the refrigerant occurs easily particularly in the communicating space from which the refrigerant is distributed into the plurality of flat tubes (31). Thus, according to the above-described configuration, the drift of the refrigerant is reduced more significantly even if the amount of the refrigerant that flowed into the heat exchanger is small. This allows the heat exchanger to exhibit sufficiently good performance.

According to the second aspect of the present disclosure, the heat exchanger is configured such that the number of the heat exchange sections of each of the heat exchange regions (35, 37) (37, 135, 235) (335, 337, 365, 367) gradually increases from the most upstream heat exchange region (37) (337) toward the most downstream heat exchange region (35) (135) (335) when the heat exchanger functions as an evaporator. Thus, the more downstream the heat exchange region is located, the more the number of the corresponding communicating spaces increases. This allows for effectively reducing the drift of the refrigerant in the communicating spaces, although which occurs more easily in the more downstream heat exchange region among the plurality of heat exchange regions (35, 37) (37, 135, 235) (335, 337, 365, 367) connected in series when the heat exchanger functions as an evaporator. This allows the heat exchanger to exhibit sufficiently good performance.

According to the fourth aspect of the present disclosure, between two of the heat exchange regions (35, 37) (135, 235) (335, 365), a downstream one (35) (135) (335) of which has more heat exchange sections than an upstream one (37) (235) (365) when the heat exchanger functions as an evaporator, a branch pipe (110, 120, 130) is provided to connect each of the heat exchange sections in the upstream heat exchange section (37) (235) (365) to the plurality of mutually different heat exchange sections of the downstream heat exchange region (35) (135) (335). This allows for easy provision of the configuration in which the downstream heat exchange region (35) (135) (335) has more heat exchange sections than the upstream heat exchange region (37) (235) (365) when the heat exchanger functions as an evaporator.

According to the fifth aspect of the present disclosure, among the plurality of heat exchange sections of the heat exchange regions (35, 37) (37, 135, 235) (335, 337, 365, 367) having different numbers of flat tubes (31), the heat exchange section having a larger number of flat tubes (31) and thus causing the drift of the refrigerant easily in the corresponding communicating space when the heat exchanger functions as an evaporator is arranged at a lower position where a large amount of liquid refrigerant flows more easily. Since a large amount of liquid refrigerant flows into the communicating space of the heat exchange section where the drift of the refrigerant occurs easily when the heat exchanger functions as an evaporator, the drift of the refrigerant in the communicating space is reducible. This allows the heat exchanger to exhibit sufficiently good performance.

DESCRIPTION OF EMBODIMENTS

Embodiments of the present invention will be described in detail below with reference to the drawings. The embodiments and alternatives to be described below are merely illustrative ones in nature, and do not intend to limit the scope of the present invention or applications or uses thereof.

First Embodiment of the Invention

A first embodiment of the present invention will be described below. A heat exchanger of this embodiment is an outdoor heat exchanger (23) provided in an air conditioner (10). The air conditioner (10) will now be described first, and then the outdoor heat exchanger (23) will be described in detail later.

—Air Conditioner—

Figure 1:
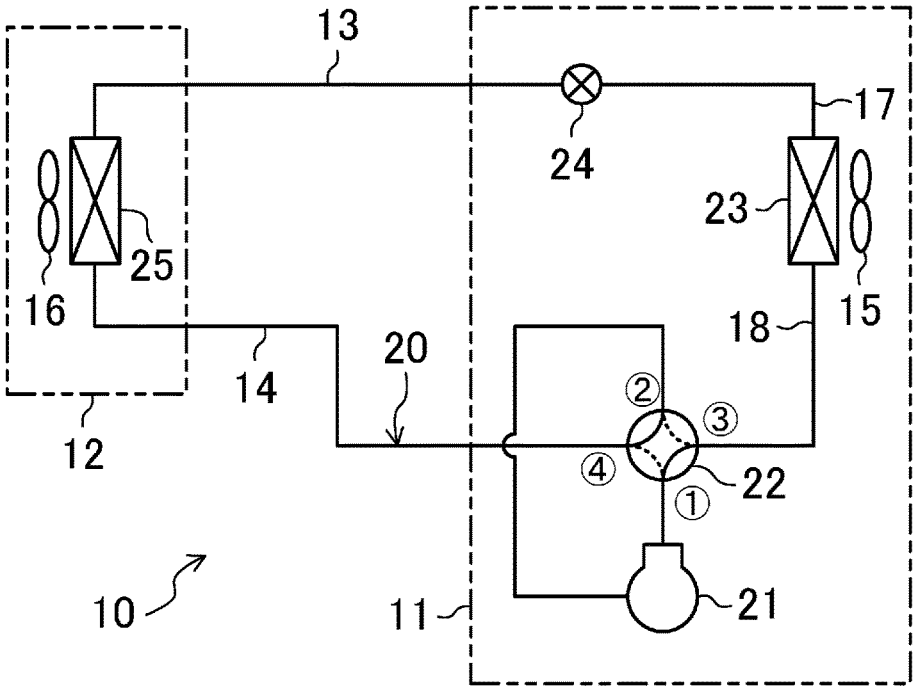
FIG. 1 is a refrigerant circuit diagram illustrating a general configuration for an air conditioner including an outdoor heat exchanger of a first embodiment.

The air conditioner (10) will be described below with reference to FIG. 1.

<Configuration for Air Conditioner>

The air conditioner (10) includes an outdoor unit (11) and an indoor unit (12). The outdoor and indoor units (11) and (12) are connected to each other through a liquid communication pipe (13) and a gas communication pipe (14). In the air conditioner (10), the outdoor unit (11), the indoor unit (12), the liquid communication pipe (13) and the gas communication pipe (14) form a refrigerant circuit (20).

The refrigerant circuit (20) includes a compressor (21), a four-way switching valve (22), the outdoor heat exchanger (23), an expansion valve (24), and an indoor heat exchanger (25). The compressor (21), the four-way switching valve (22), the outdoor heat exchanger (23) and the expansion valve (24) are housed in the outdoor unit (11). The outdoor unit (11) is provided with an outdoor fan (15) for supplying outdoor air to the outdoor heat exchanger (23). On the other hand, the indoor heat exchanger (25) is housed in the indoor unit (12). The indoor unit (12) is provided with an indoor fan (16) for supplying indoor air to the indoor heat exchanger (25).

The refrigerant circuit (20) is a closed circuit filled with a refrigerant. In the refrigerant circuit (20), the compressor (21) includes a discharge pipe connected to a first port of the four-way switching valve (22), and a suction pipe connected to a second port of the four-way switching valve (22). Also, in the refrigerant circuit (20), the outdoor heat exchanger (23), the expansion valve (24) and the indoor heat exchanger (25) are arranged in this order from a third port to a fourth port of the four-way switching valve (22). In this refrigerant circuit (20), the outdoor heat exchanger (23) is connected to the expansion valve (24) through a pipe (17), and is connected to the third port of the four-way switching valve (22) through a pipe (18).

The compressor (21) is a hermetic scroll or rotary compressor. The four-way switching valve (22) is switchable between a first state (indicated by the solid curves in FIG. 1) where the first port communicates with the third port and the second port communicates with the fourth port, and a second state (indicated by the broken curves in FIG. 1) where the first port communicates with the fourth port and the second port communicates with the third port. The expansion valve (24) is a so-called electronic expansion valve.

The outdoor heat exchanger (23) allows outdoor air to exchange heat with the refrigerant. The outdoor heat exchanger (23) will be described later. On the other hand, the indoor heat exchanger (25) allows indoor air to exchange heat with the refrigerant. The indoor heat exchanger (25) is a so-called cross-fin type fin-and-tube heat exchanger including a circular heat transfer tube.

<Operation Mechanism of Air Conditioner>

The air conditioner (10) selectively performs cooling operation and heating operation.

During the cooling operation, the refrigerant circuit (20) performs a refrigeration cycle with the four-way switching valve (22) set to the first state. In this state, the refrigerant circulates through the outdoor heat exchanger (23), the expansion valve (24) and the indoor heat exchanger (25) in this order, the outdoor heat exchanger (23) functions as a condenser, and the indoor heat exchanger (25) functions as an evaporator. In the outdoor heat exchanger (23), a gas refrigerant coming from the compressor (21) dissipates heat to the outdoor air to condense. Then, the condensed refrigerant flows toward the expansion valve (24).

During the heating operation, the refrigerant circuit (20) performs a refrigeration cycle with the four-way switching valve (22) set to the second state. In this state, the refrigerant circulates through the indoor heat exchanger (25), the expansion valve (24) and the outdoor heat exchanger (23) in this order, the indoor heat exchanger (25) functions as a condenser, and the outdoor heat exchanger (23) functions as an evaporator. The refrigerant expanded in passing through the expansion valve (24) and turned into a gas-liquid two-phase refrigerant flows into the outdoor heat exchanger (23). The refrigerant that flowed into the outdoor heat exchanger (23) absorbs heat from the outdoor air to evaporate, and then flows toward the compressor (21).

—Outdoor Heat Exchanger—

The outdoor heat exchanger (23) will be described with reference to FIGS. 2-7. The number of flat tubes (31) described below is merely an example.

Figure 2:
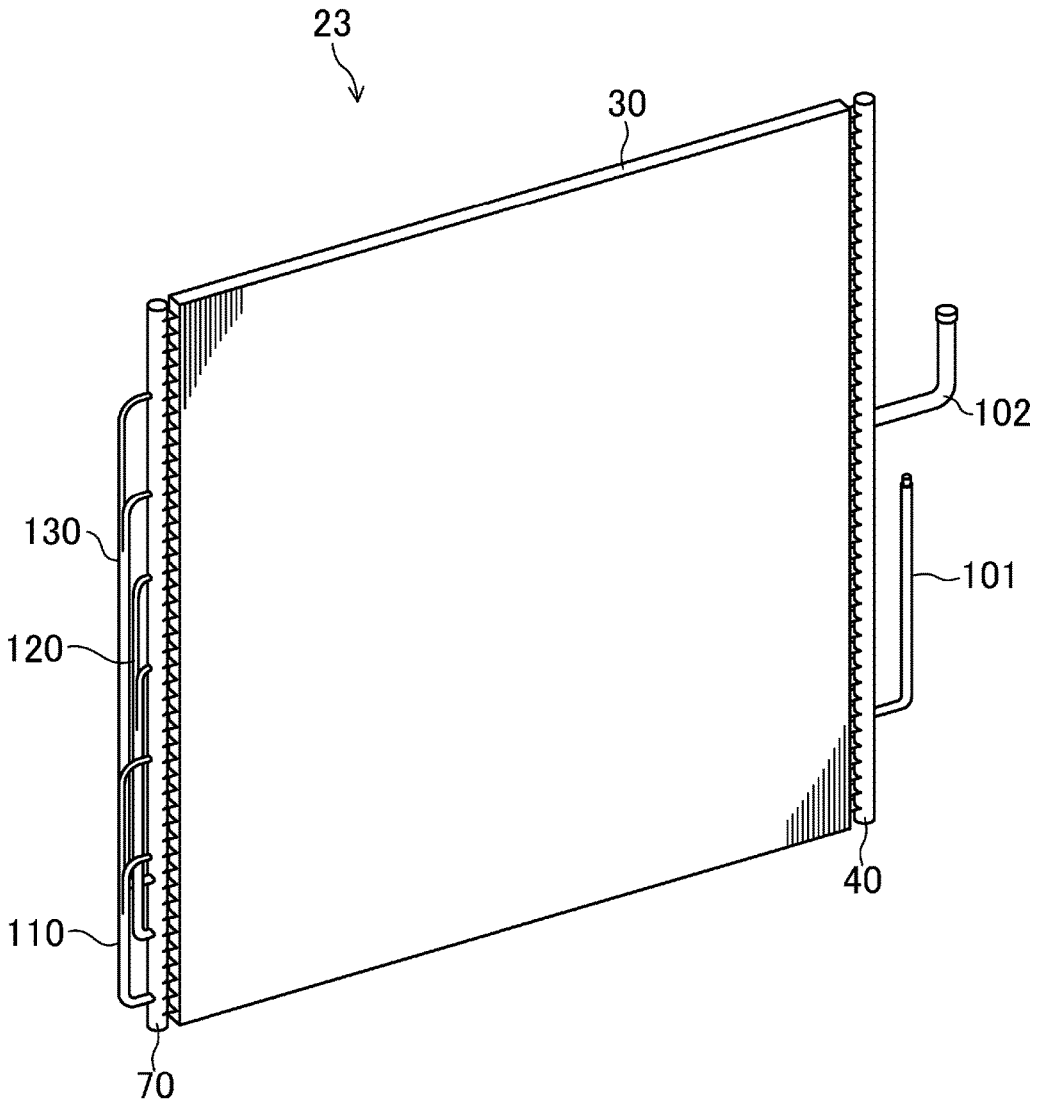
FIG. 2 is a perspective view illustrating a general configuration for the outdoor heat exchanger of the first embodiment.

As illustrated in FIG. 2, the outdoor heat exchanger (23) is an air heat exchanger and has a single heat exchanger unit (30).

Figure 3:
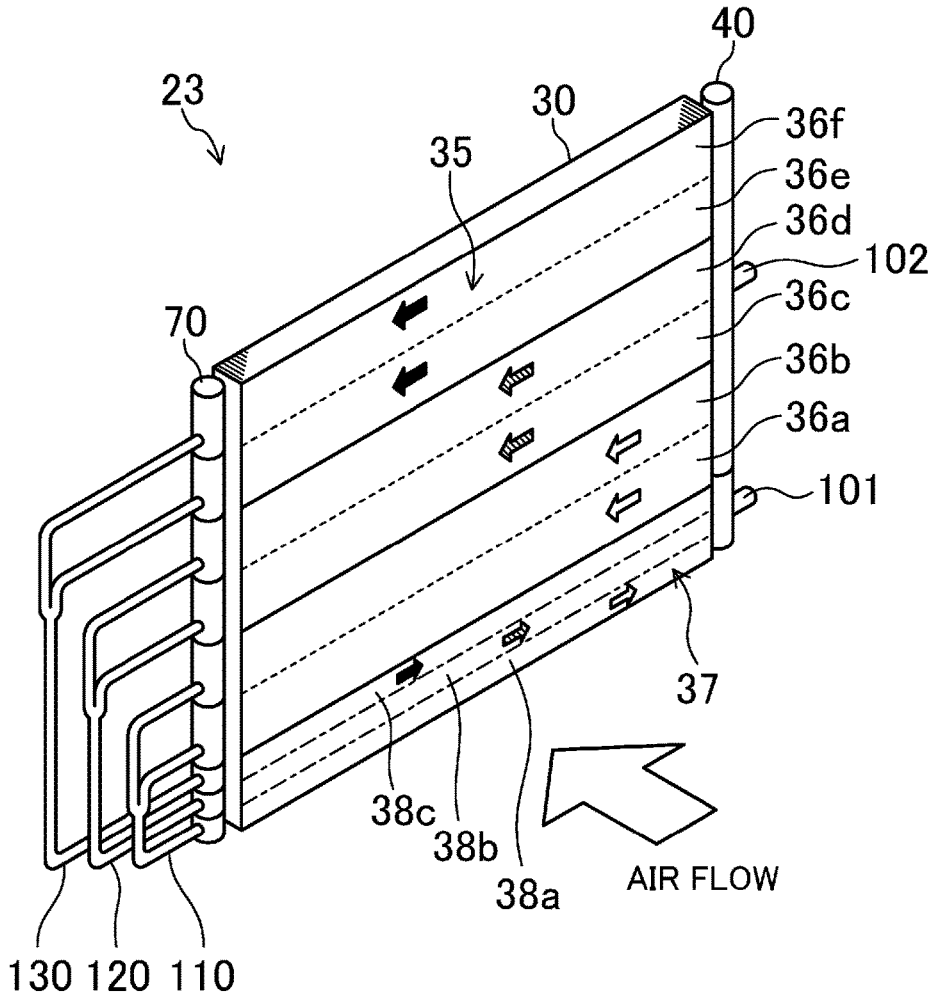
FIG. 3 is a general perspective view of a heat exchanger unit of the first embodiment illustrating how a refrigerant flows when the outdoor heat exchanger functions as a condenser.
Figure 5:
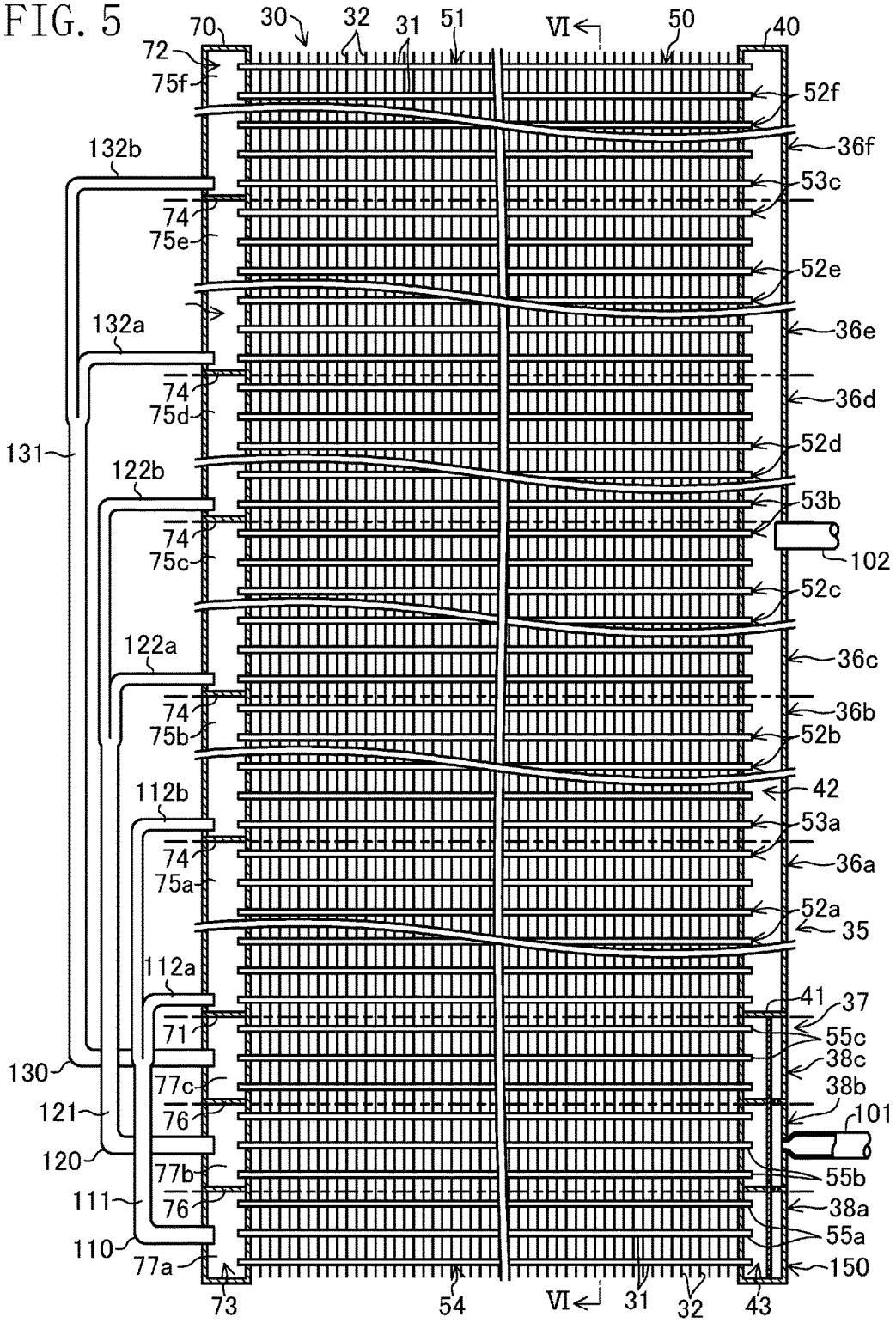
FIG. 5 is a partial cross-sectional view of the heat exchanger unit of the first embodiment as viewed from the front.

As illustrated also in FIGS. 3 and 5, the heat exchanger unit (30) includes a single first header collection pipe (40), a single second header collection pipe (70), multiple flat tubes (31) and multiple fins (32). The first and second header collection pipes (40) and (70), the flat tubes (31) and the fins (32) are aluminum alloy members, and are joined to one another by brazing.

Although the detail will be described later, the heat exchanger unit (30) is divided into two vertically arranged regions. That is, the heat exchanger unit (30) is divided into an upper principal heat exchange region (35) and a lower auxiliary heat exchange region (37).

Each of the first and second header collection pipes (40) and (70) is a long, narrow cylindrical pipe having closed ends. In FIG. 5, the first header collection pipe (40) is arranged in an upright state on a right end of the heat exchanger unit (30), and the second header collection pipe (70) is arranged in an upright state on a left end of the heat exchanger unit (30). That is, the first and second header collection pipes (40) and (70) are arranged so that their axial direction extends in the vertical direction.

Figure 6:
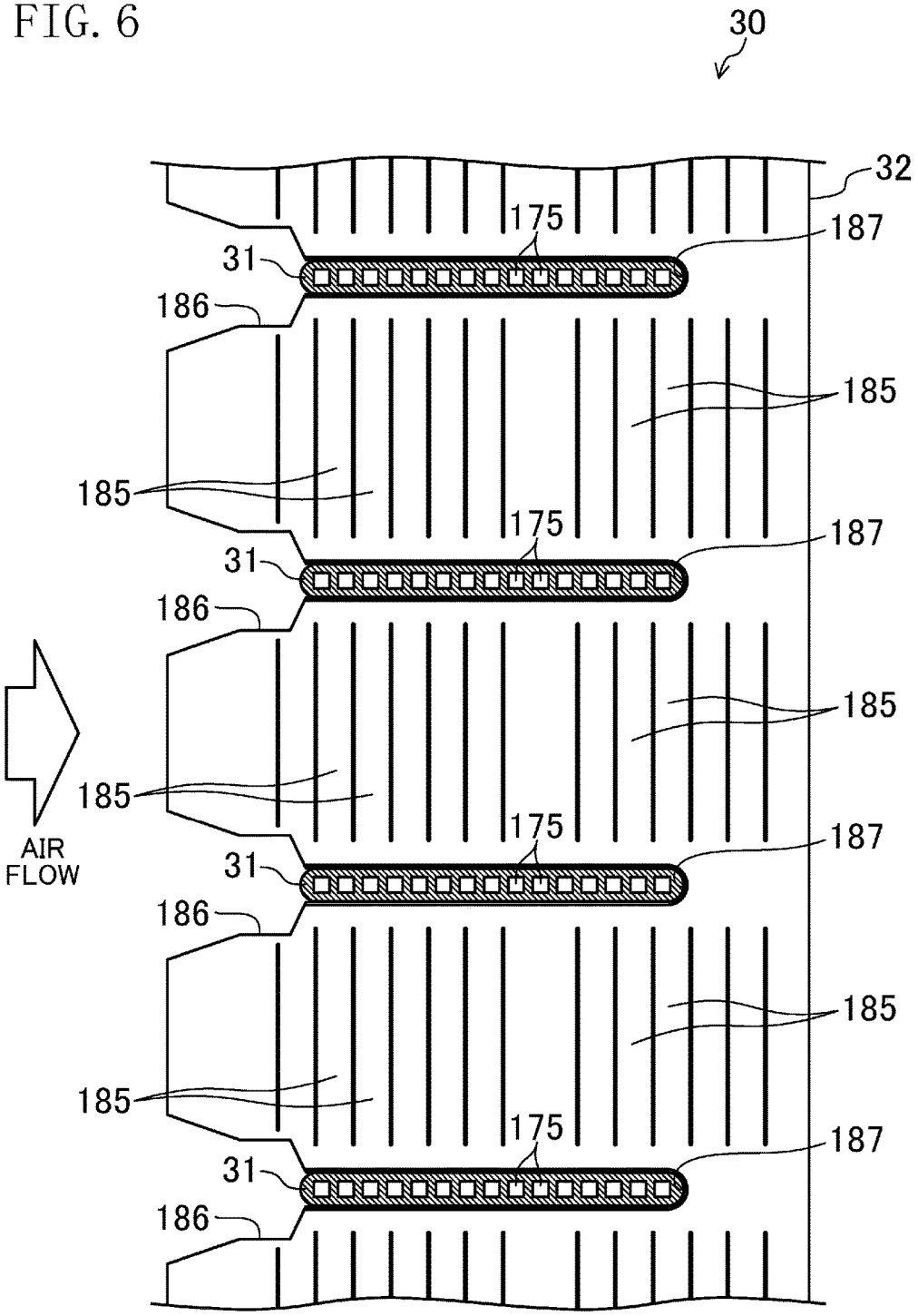
FIG. 6 is a partially enlarged cross-sectional view of the heat exchanger unit taken along the line VI-VI shown in FIG. 5.

As illustrated in FIG. 6, each of the flat tubes (31) is a heat transfer tube having a flat oval cross-section. As illustrated in FIG. 5, in the heat exchanger unit (30), the plurality of flat tubes (31) are arranged such that their axial direction extend along the lateral direction and flat surfaces of each of the flat tubes face those of adjacent flat tubes. The plurality of flat tubes (31) are arranged vertically at regular intervals, and their axial directions are substantially parallel to each other. Each of the flat tubes (31) has an end inserted in the first header collection pipe (40) and the other end inserted in the second header collection pipe (70). The flat tubes (31) provided in the heat exchanger unit (30) constitute a tube bank (50).

As illustrated in FIG. 6, a plurality of fluid passages (175) are formed in each of the flat tubes (31). The fluid passages (175) extend in the axial direction of the flat tubes (31), and are aligned in a width direction of the flat tubes (31, 61). Each of the fluid passages (175) opens at both end surfaces of each of the flat tubes (31). The refrigerant supplied to the heat exchanger unit (30) exchanges heat with the air while flowing through the fluid passages (175) in the flat tubes (31).

As illustrated in FIG. 6, each of the fins (32) is a vertically elongated plate fin formed by pressing a metal plate. Each of the fins (32) has a plurality of long narrow notches (186) extending in the width direction of the fin (32) from a front edge (i.e., a windward edge) of the fin (32). The plurality of notches (186) are formed in the fin (32) at regular intervals in the longitudinal direction of the fins (32) (the vertical direction). A leeward portion of each notch (186) serves as a tube receiving portion (187). The flat tube (31) is inserted in the tube receiving portion (187) of the fin (32), and is joined to a peripheral edge portion of the tube receiving portion (187) by brazing. Further, the fin (32) is provided with louvers (185) for promoting heat transfer. The plurality of fins (32) are arranged at regular intervals in the axial direction of the flat tubes (31).

As illustrated in FIGS. 3 and 5, the heat exchanger unit (30) is divided into two heat exchange regions (35, 37) arranged one above the other. The heat exchanger unit (30) includes an upper principal heat exchange region (35) and a lower auxiliary heat exchange region (37).

Among the flat tubes (31) provided in the heat exchanger unit (30), those located in the principal heat exchange region (35) constitute a principal bank portion (51), while those located in the auxiliary heat exchange region (37) constitute an auxiliary bank portion (54). That is, some of the flat tubes (31) constituting the tube bank (50) constitute the auxiliary bank portion (54), and the rest of the flat tubes (31) constitutes the principal bank portion (51). Although the detail will be described later, the number of the flat tubes (31) constituting the auxiliary bank portion (54) is smaller than that of the flat tubes (31) constituting the principal bank portion (51).

The principal heat exchange region (35) is divided into six vertically arranged principal heat exchange sections (36*a*-360. On the other hand, the auxiliary heat exchange region (37) is divided into three auxiliary heat exchange sections (38*a*-38*c*). The number of the principal and auxiliary heat exchange sections (36*a*-36*f*) and (38*a*-38*c*) are merely examples.

The principal heat exchange region (35) includes a first principal heat exchange section (36*a*), a second principal heat exchange section (36*b*), a third principal heat exchange section (36*c*), a fourth principal heat exchange section (36*d*), a fifth principal heat exchange section (36*e*) and a sixth principal heat exchange section (360 which are arranged in this order from bottom to top. Twelve flat tubes (31) are provided in the first principal heat exchange section (36*a*), while eleven flat tubes (31) are provided in each of the second to sixth principal heat exchange sections (36*b*-36*f*). That is, in this embodiment, the first principal heat exchange section (36*a*) having the largest number of flat tubes (31) among the six principal heat exchange sections (36*a*-36*f*) is the lowermost heat exchange section in the principal heat exchange region (35).

The twelve flat tubes (31) provided in the first principal heat exchange section (36*a*) constitute a first principal bank block (52*a*). The eleven flat tubes (31) provided in the second principal heat exchange section (36*b*) constitute a second principal bank block (52*b*). The eleven flat tubes (31) provided in the third principal heat exchange section (36*c*) constitute a third principal bank block (52*c*). The eleven flat tubes (31) provided in the fourth principal heat exchange section (36*d*) constitute a fourth principal bank block (52*d*). The eleven flat tubes (31) provided in the fifth principal heat exchange section (36*e*) constitute a fifth principal bank block (52*e*). The eleven flat tubes (31) provided in the sixth principal heat exchange section (360 constitute a sixth principal bank block (520.

The first and second principal bank blocks (52*a*) and (52*b*) constitute a first principal bank block group (53*a*). The third and fourth principal bank blocks (52*c*) and (52*d*) constitute a second principal bank block group (53*b*). The fifth and sixth principal bank blocks (52*e*) and (520 constitute a third principal bank block group (53*c*).

The auxiliary heat exchange region (37) includes a first auxiliary heat exchange section (38*a*), a second auxiliary heat exchange section (38*b*) and a third auxiliary heat exchange section (38*c*) arranged in this order from bottom to top. Three flat tubes (31) are provided in each of the auxiliary heat exchange sections (38*a*-38*c*).

The three flat tubes (31) provided in the first auxiliary heat exchange section (38*a*) constitute a first auxiliary bank block (55*a*). The three flat tubes (31) provided in the second auxiliary heat exchange section (38*b*) constitute a second auxiliary bank block (55*b*). The three flat tubes (31) provided in the third auxiliary heat exchange section (38*c*) constitute a third auxiliary bank block (55*c*). The auxiliary bank blocks (55*a*-55*c*) may include mutually different numbers of the flat tubes (31).

As illustrated in FIG. 5, a space inside the first header collection pipe (40) is divided vertically by a partition plate (41). In the first header collection pipe (40), a space above the partition plate (41) is an upper space (42) and a space below the partition plate (41) is a lower space (43).

The upper space (42) communicates with all the flat tubes (31) constituting the principal bank portion (51), that is, all the flat tubes (31) in the principal heat exchange region (35). In other words, in the first header collection pipe (40), communicating spaces formed in a one-to-one relationship with the heat exchange sections (36*a*-360 of the principal heat exchange region (35) communicate with each other to form the single upper space (42). A gas connection pipe (102) is connected to a portion of the first header collection pipe (40) forming the upper space (42). The gas connection pipe (102) is connected to the pipe (18) constituting the refrigerant circuit (20).

A liquid connection pipe (101) is connected to a portion of the first header collection pipe (40) forming the lower space (43). The liquid connection pipe (101) is connected to the pipe (17) constituting the refrigerant circuit (20). As described in detail later, a portion of the first header collection pipe (40) forming the lower space (43) constitutes a distributor (150) for distributing a refrigerant into the three auxiliary heat exchange sections (38*a*-38*c*).

As illustrated in FIG. 5, a space inside the second header collection pipe (70) is divided vertically by a partition plate (71). In the second header collection pipe (70), a space above the partition plate (71) is an upper space (72), and a space below the partition plate (71) is a lower space (73).

The upper space (72) is divided into six principal communicating spaces (75*a*-75*f*) by five partition plates (74). That is, a first principal communicating space (75*a*), a second principal communicating space (75*b*), a third principal communicating space (75*c*), a fourth principal communicating space (75*d*), a fifth principal communicating space (75*e*) and a sixth principal communicating space (750 are provided in this order from bottom to top in the second header collection pipe (70) above the partition plate (71).

The first principal communicating space (75*a*) communicates with the twelve flat tubes (31) in the first principal heat exchange section (36*a*) constituting the first principal bank block (52*a*). The second principal communicating space (75*b*) communicates with the eleven flat tubes (31) in the second principal heat exchange section (36*b*) constituting the second principal bank block (52*b*). The third principal communicating space (75*c*) communicates with the eleven flat tubes (31) in the third principal heat exchange section (36*c*) constituting the third principal bank block (52*c*). The fourth principal communicating space (75*d*) communicates with the eleven flat tubes (31) in the fourth principal heat exchange section (36*d*) constituting the fourth principal bank block (52*d*). The fifth principal communicating space (75*e*) communicates with the eleven flat tubes (31) in the fifth principal heat exchange section (36*e*) constituting the fifth principal bank block (52*e*). The sixth principal communicating space (75*f*) communicates with the eleven flat tubes (31) in the sixth principal heat exchange section (36*f*) constituting the sixth principal bank block (52*f*).

The lower space (73) is divided into three auxiliary communicating spaces (77*a*-77*c*) by two partition plates (76). That is, a first auxiliary communicating space (77*a*), a second auxiliary communicating space (77*b*) and a third auxiliary communicating space (77*c*) are provided in this order from bottom to top in the second header collection pipe (70) below the partition plate (71).

The first auxiliary communicating space (77*a*) communicates with the three flat tubes (31) in the first auxiliary heat exchange section (38*a*) constituting the first auxiliary bank block (55*a*). The second auxiliary communicating space (77*b*) communicates with the three flat tubes (31) in the second auxiliary heat exchange section (38*b*) constituting the second auxiliary bank block (55*b*). The third auxiliary communicating space (77*c*) communicates with the three flat tubes (31) in the third auxiliary heat exchange section (38*c*) constituting the third auxiliary bank block (55*c*).

Three connecting branch pipes (110, 120, 130) are attached to the second header collection pipe (70). Each of the connecting branch pipes (110, 120, 130) includes a main portion (111, 121, 131) and two branched portions (112*a*, 112*b*, 122*a*, 122*b*, 132*a*, 132*b*) connected to an end of the main portion (111, 121, 131).

A first connecting branch pipe (110) connects the first auxiliary bank block (55*a*) to the first principal bank block group (53*a*). Specifically, in the first connecting branch pipe (110), an opening end of the main portion (111) communicates with the first auxiliary communicating space (77*a*), an opening end of one of the branched portions (112*a*) communicates with the first principal communicating space (75*a*), and an opening end of the other branched portion (112*b*) communicates with the second principal communicating space (75*b*). Thus, the first auxiliary communicating space (77*a*) is connected to both of the first principal communicating space (75*a*) corresponding to the first principal bank block (52*a*) and the second principal communicating space (75*b*) corresponding to the second principal bank block (52*b*).

A second connecting branch pipe (120) connects the second auxiliary bank block (55*b*) to the second principal bank block group (53*b*). Specifically, in the second connecting branch pipe (120), an opening end of the main portion (121) communicates with the second auxiliary communicating space (77*b*), an opening end of one of the branched portions (122*a*) communicates with the third principal communicating space (75*c*), and an opening end of the other branched portion (122*b*) communicates with the fourth principal communicating space (75*d*). Thus, the second auxiliary communicating space (77*b*) is connected to both of the third principal communicating space (75*c*) corresponding to the third principal bank block (52*c*) and the fourth principal communicating space (75*d*) corresponding to the fourth principal bank block (52*d*).

A third connecting branch pipe (130) connects the third auxiliary bank block (55*c*) to the third principal bank block group (53*c*). Specifically, in the third connecting branch pipe (130), an opening end of the main portion (131) communicates with the third auxiliary communicating space (77*c*), an opening end of one of the branched portions (132*a*) communicates with the fifth principal communicating space (75*e*), and an opening end of the other branched portion (132*b*) communicates with the sixth principal communicating space (750. Thus, the third auxiliary communicating space (77*c*) is connected to both of the fifth principal communicating space (75*e*) corresponding to the fifth principal bank block (52*e*) and the sixth principal communicating space (750 corresponding to the sixth principal bank block (520.

The first to third connecting branch pipes (110, 120, 130) are different from a so-called distributor because they have no constructions in the main portions (111, 121, 131), and distribute the refrigerant without having its pressure reduced.

<Configuration for Distributor>

As can be seen from the foregoing, a portion of the first header collecting pipe (40) forming the lower space (43) constitutes the distributor (150). When the outdoor heat exchanger (23) functions as an evaporator, the distributor (150) distributes the gas-liquid two-phase refrigerant supplied to the outdoor heat exchanger (23) into the three auxiliary heat exchange sections (38*a*-38*c*). The distributor (150) will now be described with reference to FIG. 7.

In the lower space (43), two horizontal partition plates (160, 162) and a single vertical partition plate (164) are provided. The lower space (43) is divided into three communicating chambers (151-153), a single mixing chamber (154), and two intermediate chambers (155, 156) by the two horizontal partition plates (160, 162) and the single vertical partition plate (164).

Specifically, each of the horizontal partition plates (160, 162) is arranged so as to cross, and divide vertically, the lower space (43). The lower horizontal partition plate (160) is arranged between the first and second auxiliary bank blocks (55*a*) and (55*b*), and the upper horizontal partition plate (162) is arranged between the second and third auxiliary bank blocks (55*b*) and (55*c*). The vertical partition plate (164) is a long, narrow rectangular plate member. The vertical partition plate (164) is arranged along the axial direction of the first header collection pipe (40) to divide the lower space (43) into a space closer to the flat tubes (31) and a space closer to the liquid connection pipe (101).

A portion of the lower space (43) below the lower horizontal partition plate (160) is divided by the vertical partition plate (164) into a first communicating chamber (151) closer to the flat tubes (31) and a lower intermediate chamber (155) closer to the liquid connection pipe (101). The first communicating chamber (151) communicates with the three flat tubes (31) constituting the first auxiliary bank block (55*a*).

A portion of the lower space (43) between the lower and upper horizontal partition plates (160) and (162) is divided by the vertical partition plate (164) into a second communicating chamber (152) closer to the flat tubes (31) and the mixing chamber (154) closer to the liquid connection pipe (101). The second communicating chamber (152) communicates with the three flat tubes (31) constituting the second auxiliary bank block (55*b*). The mixing chamber (154) communicates with the liquid connection pipe (101).

A portion of the lower space (43) above the upper horizontal partition plate (162) is divided by the vertical partition plate (164) into a third communicating chamber (153) closer to the flat tubes (31) and an upper intermediate chamber (156) closer to the liquid connection pipe (101). The third communicating chamber (153) communicates with the three flat tubes (31) constituting the third auxiliary bank block (55*c*).

Communicating holes (165*a*, 165*b*) are formed through an upper portion and a lower portion of the vertical partition plate (164), respectively. Each of the communicating holes (165*a*, 165*b*) is a horizontally oriented rectangular through hole. The communicating hole (165*b*) in the lower portion of the vertical partition plate (164) is formed near a lower end of a portion of the vertical partition plate (164) below the lower horizontal partition plate (160) and allows the first communicating chamber (151) to communicate with the lower intermediate chamber (155). The communicating hole (165*a*) in the upper portion of the vertical partition plate (164) is formed near a lower end of a portion of the vertical partition plate (164) above the upper horizontal partition plate (162) to allow the third communicating chamber (153) to communicate with the upper intermediate chamber (156).

A flow rate adjusting hole (161) is formed through a portion of the lower horizontal partition plate (160) facing the mixing chamber (154). The first communicating chamber (151) communicates with the mixing chamber (154) through the flow rate adjusting hole (161). A flow rate adjusting hole (163) is formed through a portion of the upper horizontal partition plate (162) facing the mixing chamber (154). The third communicating chamber (153) communicates with the mixing chamber (154) through the flow rate adjusting hole (163). A flow rate adjusting hole (166) is formed near a lower end of a portion of the vertical partition plate (164) facing the mixing chamber (154). The second communicating chamber (152) communicates with the mixing chamber (154) through the flow rate adjusting hole (166).

In the distributor (150), the flow rate adjusting holes (161), (163) and (166) of the lower and upper horizontal partition plates (160) and (162) and the vertical partition plate (164) are circular through holes which have relatively small diameters. In the distributor (150), the flow rate adjusting holes (161, 163, 166) have their opening areas (i.e., their diameters) set so that the refrigerant is distributed at predetermined rates to each of the auxiliary bank blocks (55*a*-55*c*).

<Refrigerant Flow in Outdoor Heat Exchanger Functioning as Condenser>

During a cooling operation of the air conditioner (10), the outdoor heat exchanger (23) functions as a condenser. A refrigerant flow in the outdoor heat exchanger (23) performing the cooling operation will be described below.

To the outdoor heat exchanger (23), a gas refrigerant discharged from the compressor (21) is supplied through the pipe (18). As illustrated in FIG. 3, the refrigerant supplied to the gas connection pipe (102) through the pipe (18) passes through the principal heat exchange sections (36*a*-36*c*) of the principal heat exchange region (35) and the auxiliary heat exchange sections (38*a*-38*c*) of the auxiliary heat exchange region (37) in this order, and flows into the pipe (17) through the liquid connection pipe (101).

The refrigerant flow in the outdoor heat exchanger (23) will be described in detail below.

As illustrated in FIG. 5, a single-phase gas refrigerant that flowed from the gas connection pipe (102) into the upper space (42) of the first header collection pipe (40) is divided to flow into the flat tubes (31) of the principal heat exchange sections (36*a*-360 constituting the principal bank blocks (52*a*-52*f*). The refrigerant flowing through the flat tubes (31) of the principal bank blocks (52*a*-52*f*) exchanges heat with the outdoor air supplied to the outdoor heat exchanger (23). The refrigerant that passed through the flat tubes (31) of each of the principal bank blocks (52*a*-52*f*) flows into an associated one of the principal communicating spaces (75*a*-75*f*) in the second header collection pipe (70). Flows of the refrigerant that passed through the plurality of flat tubes (31) of the first principal bank block (52*a*) enter, and merge together in, the first principal communicating space (75*a*). Flows of the refrigerant that passed through the plurality of flat tubes (31) of the second principal bank block (52*b*) enter, and merge together in, the second principal communicating space (75*b*). Flows of the refrigerant that passed through the plurality of flat tubes (31) of the third principal bank block (52*c*) enter, and merge together in, the third principal communicating space (75*c*). Flows of the refrigerant that passed through the plurality of flat tubes (31) of the fourth principal bank block (52*d*) enter, and merge together in, the fourth principal communicating space (75*d*). Flows of the refrigerant that passed through the plurality of flat tubes (31) of the fifth principal bank block (52*e*) enter, and merge together in, the fifth principal communicating space (75*e*). Flows of the refrigerant that passed through the plurality of flat tubes (31) of the sixth principal bank block (520 enter, and merge together in, the sixth principal communicating space (751).

The refrigerant in the first and second principal communicating spaces (75*a*) and (75*b*) flows into the first auxiliary communicating space (77*a*) through the first connecting branch pipe (110). The refrigerant in the third and fourth principal communicating spaces (75*c*) and (75*d*) flows into the second auxiliary communicating space (77*b*) through the second connecting branch pipe (120). The refrigerant in the fifth and sixth principal communicating spaces (75*e*) and (750 flows into the third auxiliary communicating space (77*c*) through the third connecting branch pipe (130).

The refrigerant in each of the auxiliary communicating spaces (77*a*-77*c*) flows into the flat tubes (31) of an associated one of the auxiliary bank blocks (55*a*-55*c*). The refrigerant in the first auxiliary communicating space (77*a*) flows into the flat tubes (31) of the first auxiliary bank block (55*a*). The refrigerant in the second auxiliary communicating space (77*b*) flows into the flat tubes (31) of the second auxiliary bank block (55*b*). The refrigerant in the third auxiliary communicating space (77*c*) flows into the flat tubes (31) of the third auxiliary bank block (55*c*).

The refrigerant flowing through the flat tubes (31) of each of the auxiliary bank blocks (55*a*-55*c*) exchanges heat with the outdoor air supplied to the outdoor heat exchanger (23). The refrigerant that passed through the flat tubes of each of the auxiliary bank block (55*a*-55*c*) flows into an associated one of the communicating chambers (151-153). Flows of the refrigerant that passed through the plurality of flat tubes (31) of the first auxiliary bank block (55*a*) enter, and merge together in, the first communicating chamber (151). Flows of the refrigerant that passed through the plurality of flat tubes (31) of the second auxiliary bank block (55*b*) enter, and merge together in, the second communicating chamber (152). Flows of the refrigerant that passed through the plurality of flat tubes (31) of the third auxiliary bank block (55*c*) enter, and merge together in, the third communicating chamber (153). Flows of the refrigerant coming from the communicating chambers (151-153) enter, and merge together, in the mixing chamber (154), and then the merged refrigerant flows out of the outdoor heat exchanger (23) through the liquid connection pipe (101).

<Refrigerant Flow in Outdoor Heat Exchanger Functioning as Evaporator>

During a heating operation of the air conditioner (10), the outdoor heat exchanger (23) functions as an evaporator. A refrigerant flow in the outdoor heat exchanger (23) performing the heating operation will be described below.

Figure 4:
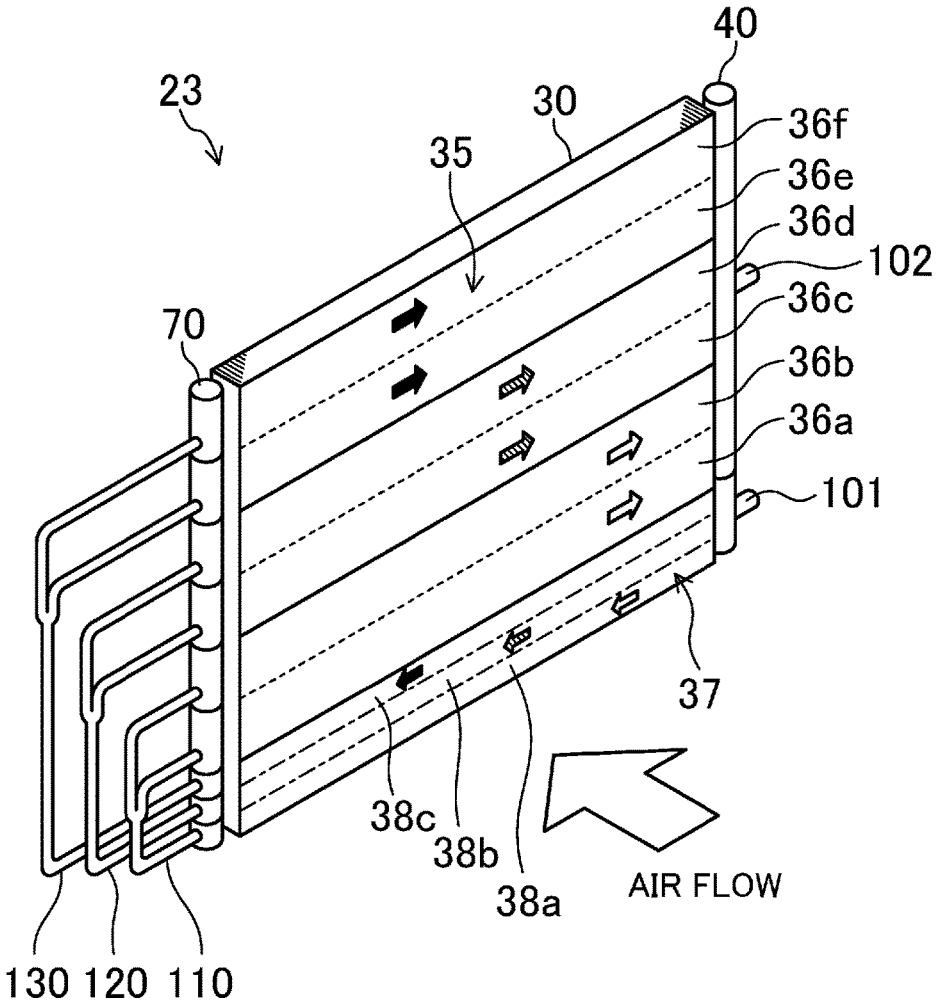
FIG. 4 is a general perspective view of the heat exchanger unit of the first embodiment illustrating how the refrigerant flows when the outdoor heat exchanger functions as an evaporator.

The refrigerant expanded in passing through the expansion valve (24) and turned into a gas-liquid two-phase refrigerant is supplied to the outdoor heat exchanger (23) through the pipe (17). As illustrated in FIG. 4, the refrigerant supplied from the pipe (17) to the liquid connection pipe (101) passes through the auxiliary heat exchange sections (38*a*-38*c*) of the auxiliary heat exchange region (37) and the principal heat exchange sections (36*a*-36*c*) of the principal heat exchange region (35) in this order, and then flows into the pipe (18) through the gas connection pipe (102).

The refrigerant flow in the outdoor heat exchanger (23) will be described in detail below.

Figure 7:
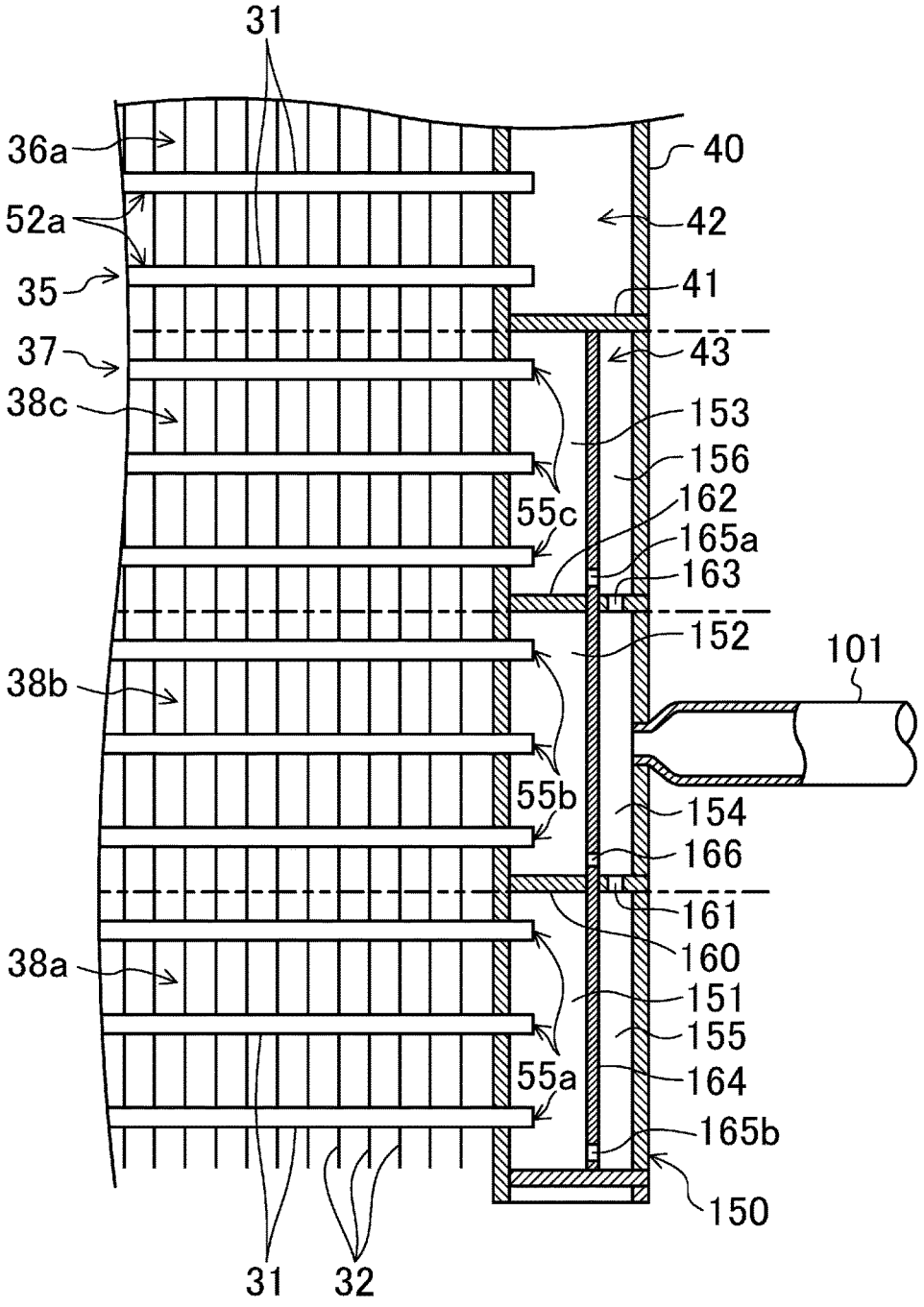
FIG. 7 is an enlarged cross-sectional view illustrating the vicinity of a lower space in a first header collection pipe of the heat exchanger unit of the first embodiment as viewed from the front.

As illustrated in FIG. 7, the gas-liquid two-phase refrigerant flowed from the liquid connection pipe (101) to the mixing chamber (154) is distributed to the three communicating chambers (151-153) so that the refrigerant flows into the flat tubes (31) of the auxiliary bank blocks (55*a*-55*c*) corresponding respectively to the communicating chambers (151-153). The refrigerant flowing through the flat tubes (31) of the auxiliary bank blocks (55*a*-55*c*) exchanges heat with the outdoor air supplied to the outdoor heat exchanger (23). Flows of the refrigerant that passed through the three flat tubes (31) of each of the auxiliary bank blocks (55*a*-55*c*) enter, and merge together in, the auxiliary communicating space (77*a*-77*c*) in the second header collection pipe (70) corresponding to each of the auxiliary bank blocks (55*a*-55*c*).

A portion of the refrigerant that flowed from the first auxiliary communicating space (77*a*) into the main portion (111) of the first connecting branch pipe (110) flows into the first principal communicating space (75*a*) through one of the branched portions (112*a*), and the rest of the refrigerant flows into the second principal communicating space (75*b*) through the other branched portion (112*b*). A portion of the refrigerant that flowed from the second auxiliary communicating space (77*b*) into the main portion (121) of the second connecting branch pipe (120) flows into the third principal communicating space (75*c*) through one of the branched portions (122*a*), and the rest of the refrigerant flows into the fourth principal communicating space (75*d*) through the other branched portion (122*b*). A portion of the refrigerant that flowed from the third auxiliary communicating space (77*c*) into the main portion (131) of the third connecting branch pipe (130) flows into the fifth principal communicating space (75*e*) through one of the branched portions (132*a*), and the rest of the refrigerant flows into the sixth principal communicating space (75*f*) through the other branched portion (132*b*).

The refrigerant that flowed into each of the communicating spaces (75*a*-75*f*) of the second header collection pipe (70) flows into the flat tubes (31) of the principal bank block (52*a*-52*f*) corresponding to the communicating space (75*a*-75*f*). The refrigerant in the first principal communicating space (75*a*) flows into the flat tubes (31) in the first principal heat exchange section (36*a*) constituting the first principal bank block (52*a*). The refrigerant in the second principal communicating space (75*b*) flows into the flat tubes (31) in the second principal heat exchange section (36*b*) constituting the second principal bank block (52*b*). The refrigerant in the third principal communicating space (75*c*) flows into the flat tubes (31) in the third principal heat exchange section (36*c*) constituting the third principal bank block (52*c*). The refrigerant in the fourth principal communicating space (75*d*) flows into the flat tubes (31) in the fourth principal heat exchange section (36*d*) constituting the fourth principal bank block (52*d*). The refrigerant in the fifth principal communicating space (75*e*) flows into the flat tubes (31) in the fifth principal heat exchange section (36*e*) constituting the fifth principal bank block (52*e*). The refrigerant in the sixth principal communicating space (750 flows into the flat tubes (31) in the sixth principal heat exchange section (360 constituting the sixth principal bank block (520.

The refrigerant flowing through the flat tubes (31) of each of the principal bank blocks (52*a*-52*f*) exchanges heat with the outdoor air supplied to the outdoor heat exchanger (23). Flows of the refrigerant that passed through the plurality of flat tubes (31) of each of the principal bank blocks (52*a*-52*f*) enter, and merge together in, the upper space (42) of the first header collection pipe (40), and the merged refrigerant flows out of the outdoor heat exchanger (23) through the gas connection pipe (102).

In the configuration according to the first embodiment, the auxiliary and principal heat exchange regions (37) and (35) are connected in series when the outdoor heat exchanger (23) functions as an evaporator, and the number of the heat exchange sections (36*a*-36*f*) of the principal heat exchange region (35) is multiple times larger than the number of the heat exchange sections (38*a*-38*c*) of the auxiliary heat exchange region (37). That is, when the outdoor heat exchanger (23) functions as an evaporator, the number of the heat exchange sections (36*a*-36*f*) of the downstream principal heat exchange region (35) is six, which is a multiple of the number (three) of the heat exchange sections (38*a*-38*c*) of the upstream auxiliary heat exchange region (37).

Advantages of First Embodiment

The outdoor heat exchanger (23) of the first embodiment is configured such that the number of the heat exchange sections (36*a*-360 in the most downstream principal heat exchange region (35) is larger than the number of the heat exchange sections (38*a*-38*c*) in the most upstream auxiliary heat exchange region (37) when the outdoor heat exchanger (23) functions as an evaporator. In this configuration, the number of communicating spaces (75*a*-75*f*) corresponding to the principal heat exchange region (35) increases, and thus the number of flat tubes (31) communicating with each of the communicating spaces (75*a*-75*f*) decreases and the height of each of the communicating spaces decreases as compared with the case where the principal and auxiliary heat exchange regions (35) and (37) have the same number of heat exchange sections. A drift of the refrigerant occurs most easily in each of the communicating spaces (75*a*-75*f*) corresponding to the most downstream principal heat exchange region (35) when the outdoor heat exchanger (23) functions as an evaporator. However, if the height of each of the communicating spaces (75*a*-75*f*) corresponding to the principal heat exchange region (35) decreases as can be seen in the foregoing, the gas and liquid refrigerants are not separated easily, and the drift of the refrigerant does not occur easily in each of the communicating spaces (75*a*-75*f*) corresponding to the principal heat exchange region (35). Thus, in the outdoor heat exchanger (23) of the first embodiment, the drift of the refrigerant is reducible in each of the communicating spaces (75*a*-75*f*) corresponding to the most downstream principal heat exchange region (35) where the drift of the refrigerant occurs most easily when the outdoor heat exchanger functions as an evaporator. This allows the outdoor heat exchanger (23) to exhibit sufficiently good performance.

When the outdoor heat exchanger (23) functions as an evaporator and the amount of the refrigerant that flowed into the outdoor heat exchanger (23) is small, the drift of the refrigerant occurs easily particularly in the communicating space from which the refrigerant is distributed into the plurality of flat tubes (31). Thus, according to the above-described configuration, the drift of the refrigerant is reducible more significantly even if the amount of the refrigerant that flowed into the outdoor heat exchanger (23) is small. This allows the outdoor heat exchanger (23) to exhibit sufficiently good performance.

Further, in the outdoor heat exchanger (23) of the first embodiment, the connecting branch pipe (branch pipe) (110, 120, 130) is provided to connect each of the heat exchange sections (38*a*-38*c*) of the upstream auxiliary heat exchange region (37) to the two mutually different heat exchange sections (36*a*-36*f*) of the downstream principal heat exchange region (35) when the outdoor heat exchanger (23) functions as an evaporator. This allows for easy provision of the configuration in which the downstream auxiliary heat exchange region (37) has more heat exchange sections than the upstream principal heat exchange region (35) when the outdoor heat exchanger (23) functions as an evaporator.

Moreover, in the outdoor heat exchanger (23) of the first embodiment, if the plurality of heat exchange sections (36*a*-36*f*) of the heat exchange region (35) have different numbers of flat tubes (31), the heat exchange section (36*a*) having a larger number of flat tubes (31) and thus causing the drift of the refrigerant easily when the outdoor heat exchanger (23) functions as an evaporator is arranged at a lower position to which a large amount of liquid refrigerant flows easily when the outdoor heat exchanger (23) functions as an evaporator. Since a large amount of the refrigerant flows into the communicating space (75*a*) corresponding to the heat exchange section (36*a*) where the larger number of flat tubes (31) are provided and the drift of the refrigerant occurs easily when the outdoor heat exchanger (23) functions as an evaporator, the drift of the refrigerant in the communicating space (75*a*) is reducible. This allows the outdoor heat exchanger (23) to exhibit sufficiently good performance.

In addition, in the outdoor heat exchanger (23) of the first embodiment, the heat exchanger unit (30) is divided into the principal heat exchange region (35) including a group of six principal heat exchange sections (36*a*-36*f*) and the auxiliary heat exchange region (37) including a group of three auxiliary heat exchange sections (38*a*-38*c*). However, in place of this configuration, the heat exchange sections connected together by each of the branch pipes (110, 120, 130) may be arranged one above the other so as to make the lengths of the connecting branch pipes (110, 120, 130) connecting each of the auxiliary heat exchange sections (38*a*-38*c*) to the associated principal heat exchange sections (36*a*-36*f*) equal. More specifically, the first auxiliary heat exchange section (38*a*) is provided below the first principal heat exchange section (36*a*), the second auxiliary heat exchange section (38*b*) is provided below the third principal heat exchange section (36*c*), and the third auxiliary heat exchange section (38*c*) is provided below the fifth principal heat exchange section (36*e*). However, in the principal and auxiliary heat exchange sections (36*a*-36*f*) and (38*a*-38*c*) connected in series when the outdoor heat exchanger (23) functions as a condenser, the refrigerant flowing through the flat tubes (31) in the auxiliary heat exchange sections (38*a*-38*c*) has a lower temperature than the refrigerant flowing through the flat tubes (31) in the principal heat exchange sections (36*a*-36*f*). Thus, the principal heat exchange section (36*a*-360 and the auxiliary heat exchange section (38*a*-38*c*) adjacent to each other exchange heat. The larger the number of the principal and auxiliary heat exchange sections adjacent to each other is, the more the performance of the outdoor heat exchanger as the condenser decreases. Therefore, just like in the outdoor heat exchanger (23) of the first embodiment, the heat exchanger unit (30) is divided into two heat exchange regions (35, 37), namely, the principal and auxiliary heat exchange regions (35) and (37), so that only one of the principal heat exchange sections (36*a*-36*f*) and only one of the auxiliary heat exchange sections (38*a*-38*c*) are adjacent to each other. As a result, the heat exchange between the principal and auxiliary heat exchange sections (36*a*-36*f*) and (38*a*-38*c*) is reducible as much as possible when the outdoor heat exchanger (23) functions as a condenser. This allows for reducing a decrease in performance of the outdoor heat exchanger as the condenser.

Second Embodiment of the Invention

Figure 8:
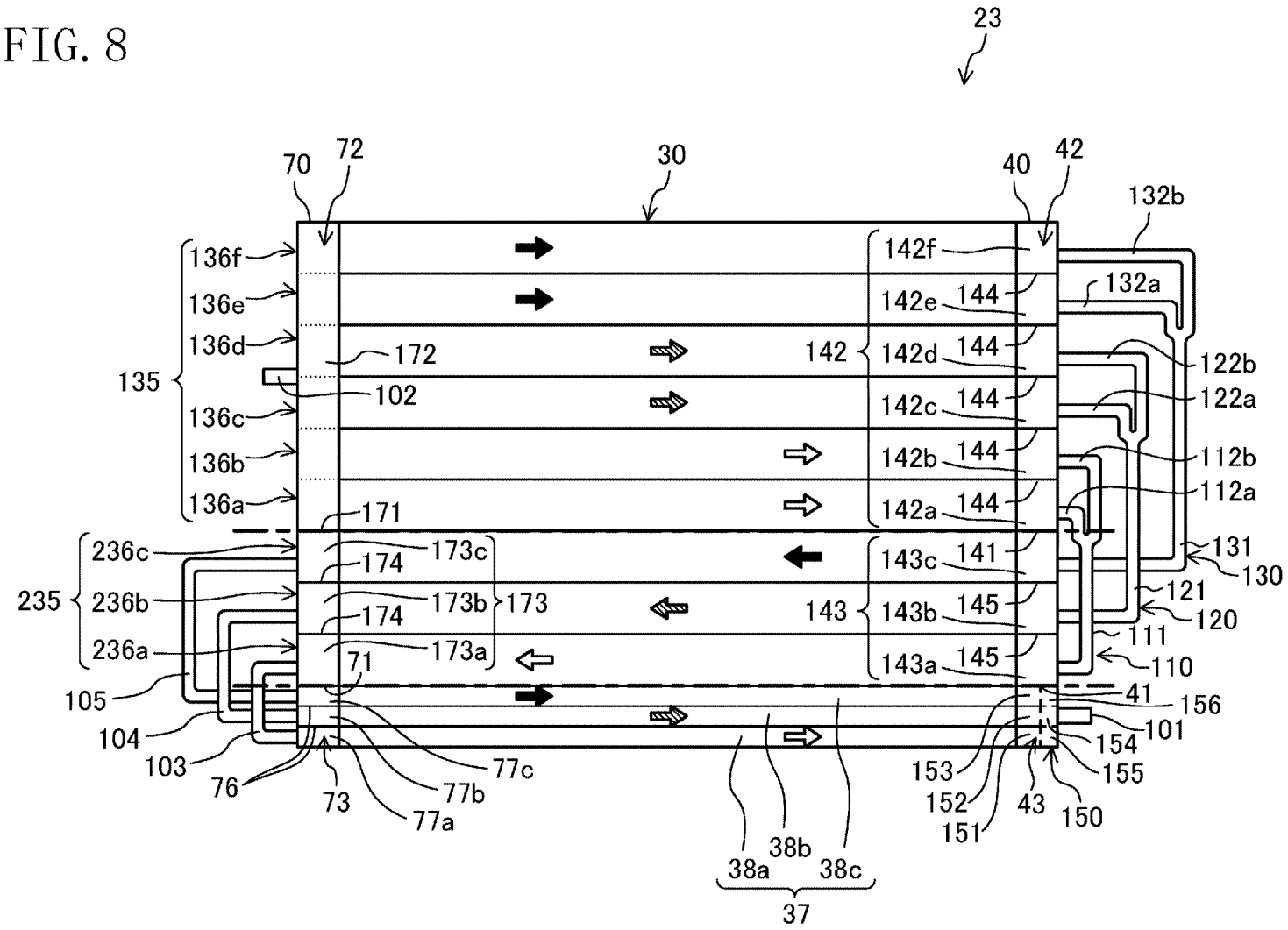
FIG. 8 is a general side view of a heat exchanger unit of a second embodiment illustrating how a refrigerant flows when an outdoor heat exchanger functions as a condenser.
Figure 9:
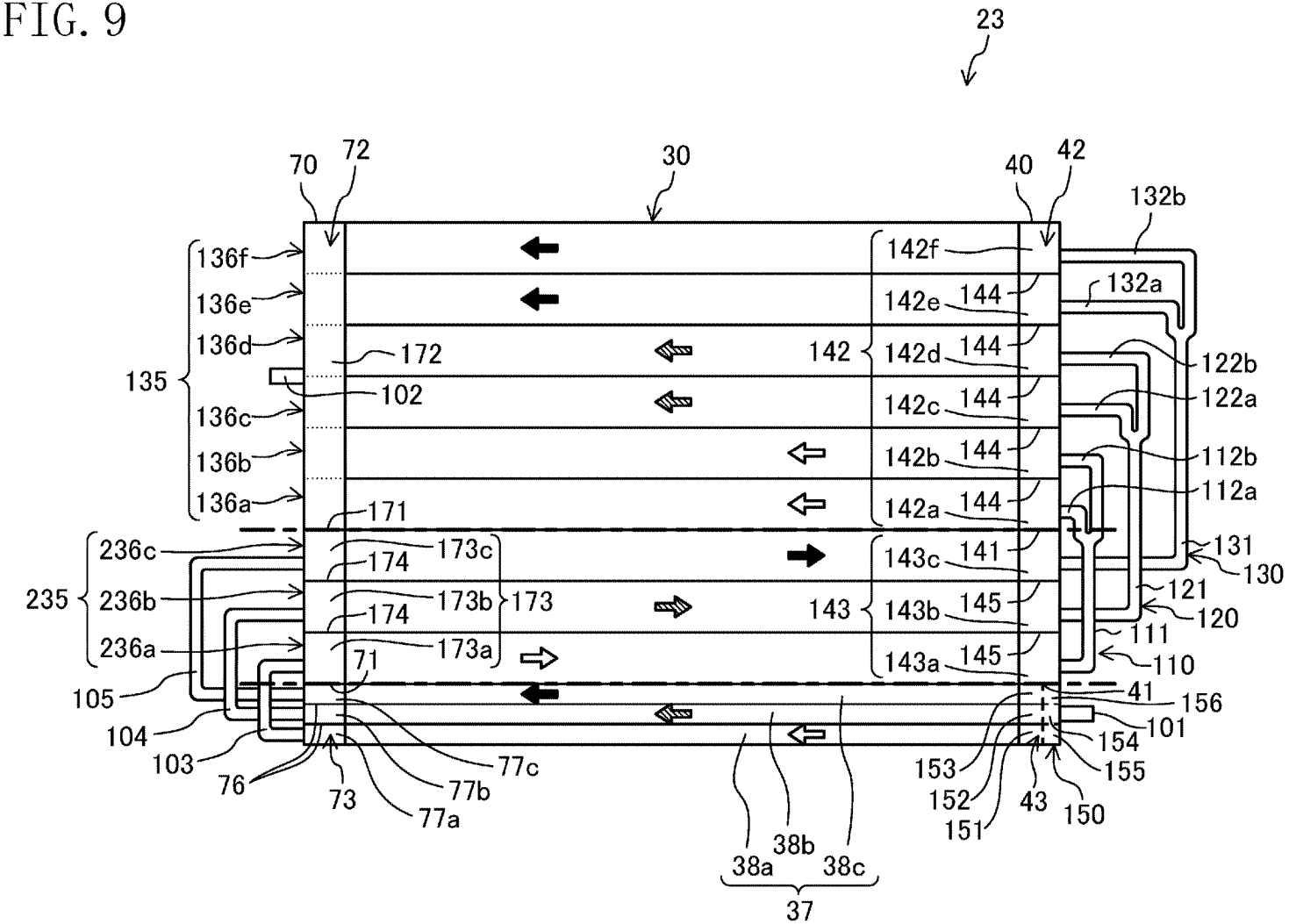
FIG. 9 is a general side view of the heat exchanger unit of the second embodiment illustrating how the refrigerant flows when the outdoor heat exchanger functions as an evaporator.

A second embodiment of the present invention will be described below. In the first embodiment, the heat exchanger unit (30) of the outdoor heat exchanger (23) is divided into two vertically arranged regions, namely, the upper principal heat exchange region (35) and the lower auxiliary heat exchange region (37). In the second embodiment, as shown in FIGS. 8 and 9, the heat exchanger unit (30) is divided into three vertically arranged regions.

In the second embodiment, just like in the first embodiment, the heat exchanger unit (30) includes a single first header collection pipe (40), a single second header collection pipe (70), multiple flat tubes (31) and multiple fins (32). On the other hand, the heat exchanger unit (30) of the second embodiment is divided into three vertically arranged regions as described above. The heat exchanger unit (30) includes an upper principal heat exchange region (135), a lower principal heat exchange region (235) and an auxiliary heat exchange region (37) arranged in this order from top to bottom.

The upper principal heat exchange region (135) includes a first upper principal heat exchange section (136*a*), a second upper principal heat exchange section (136*b*), a third upper principal heat exchange section (136*c*), a fourth upper principal heat exchange section (136*d*), a fifth upper principal heat exchange section (136*e*) and a sixth upper principal heat exchange section (1360 which are arranged in this order from bottom to top. Although not shown in FIGS. 8 and 9, twelve flat tubes (31) are provided in the first upper principal heat exchange section (136*a*), and eleven flat tubes (31) are provided in each of the second to sixth upper principal heat exchange sections (136*b*-1360.

The lower principal heat exchange region (235) includes a first lower principal heat exchange section (236*a*), a second lower principal heat exchange section (236*b*) and a third lower principal heat exchange section (236*c*) which are arranged in this order from bottom to top. Although not shown in FIGS. 8 and 9, twelve flat tubes (31) are provided in the first lower principal heat exchange section (236*a*), and eleven flat tubes (31) are provided in each of the second and third lower principal heat exchange sections (236*b*, 236*f*).

The auxiliary heat exchange region (37) includes a first auxiliary heat exchange section (38*a*), a second auxiliary heat exchange section (38*b*) and a third auxiliary heat exchange section (38*c*) which are arranged in this order from bottom to top. Although not shown in FIGS. 8 and 9, three flat tubes (31) are provided in each of the auxiliary heat exchange sections (38*a*-38*c*).

A Space inside the first header collection pipe (40) is divided vertically by a partition plate (41). In the first header collection pipe (40), a space above the partition plate (41) is an upper space (42) and a space below the partition plate (41) is a lower space (43). The upper space (42) is further divided vertically by a partition plate (141). That is, a space above the partition plate (141) is a first upper space (142) and a space below the partition plate (141) is a second upper space (143).

The first upper space (142) is divided into six upper principal communicating spaces (142*a*-1420 by five partition plates (144). That is, a first upper principal communicating space (142*a*), a second upper principal communicating space (142*b*), a third upper principal communicating space (142*c*), a fourth upper principal communicating space (142*d*), a fifth upper principal communicating space (142*e*) and a sixth upper principal communicating space (1420 are provided in this order from bottom to top in the first header collection pipe (40) above the partition plate (141).

The twelve flat tubes (31) in the first upper principal heat exchange section (136*a*) communicate with the first upper principal communicating space (142*a*). The eleven flat tubes (31) in the second upper principal heat exchange section (136*b*) communicate with the second upper principal communicating space (142*b*). The eleven flat tubes (31) in the third upper principal heat exchange section (136*c*) communicate with the third upper principal communicating space (142*c*). The eleven flat tubes (31) in the fourth upper principal heat exchange section (136*d*) communicate with the fourth upper principal communicating space (142*d*). The eleven flat tubes (31) in the fifth upper principal heat exchange section (136*e*) communicate with the fifth upper principal communicating space (142*e*). The eleven flat tubes (31) in the sixth upper principal heat exchange section (1360 communicate with the sixth upper principal communicating space (1420.

The second upper space (143) is divided by two partition plates (145) into three lower principal communicating spaces (143*a*-143*c*). That is, a first lower principal communicating space (143*a*), a second lower principal communicating space (143*b*) and a third lower principal communicating space (143*c*) are provided in this order from bottom to top in the first header collection pipe (40) below the partition plate (141).

The liquid connection pipe (101) is connected to a portion of the first header collection pipe (40) forming the lower space (43). The liquid connection pipe (101) is connected to a pipe (17) constituting the refrigerant circuit (20). Just like in the first embodiment, the portion of the first header collection pipe (40) forming the lower space (43) constitutes a distributor (150) which distributes the refrigerant into the three auxiliary heat exchange sections (38*a*-38*c*). The distributor (150) is configured in the same manner as in the first embodiment, and the lower space (43) is divided into three communicating chambers (151-153), a single mixing chamber (154) and two intermediate chambers (155, 156).

Three connecting branch pipes (110, 120, 130) are attached to the first header collection pipe (40). Each of the connecting branch pipes (110, 120, 130) includes a single main portion (111, 121, 131) and two branched portions (112*a*, 112*b*, 122*a*, 122*b*, 132*a*, 132*b*) connected to an end of the main portion (111, 121, 131).

A first connecting branch pipe (110) connects the first lower principal heat exchange section (236*a*), the first upper principal heat exchange section (136*a*) and the second upper principal heat exchange section (136*b*) together. Specifically, in the first connecting branch pipe (110), an opening end of the main portion (111) communicates with the first lower principal communicating space (143*a*), an opening end of one of the branched portions (112*a*) communicates with the first upper principal communicating space (142*a*), and an opening end of the other branched portion (112*b*) communicates with the second upper principal communicating space (142*b*). Thus, the first lower principal communicating space (143*a*) is connected to both of the first upper principal communicating space (142*a*) corresponding to the first upper principal heat exchange section (136*a*) and the second upper principal communicating space (142*b*) corresponding to the second upper principal heat exchange section (136*b*).

A second connecting branch pipe (120) connects the second lower principal heat exchange section (236*b*), the third upper principal heat exchange section (136*c*) and the fourth upper principal heat exchange section (136*d*) together. Specifically, in the second connecting branch pipe (120), an opening end of the main portion (121) communicates with the second lower principal communicating space (143*b*), an opening end of one of the branched portions (122*a*) communicates with the third upper principal communicating space (142*c*), and an opening end of the other branched portion (122*b*) communicates with the fourth upper principal communicating space (142*d*). Thus, the second lower principal communicating space (143*b*) is connected to both of the third upper principal communicating space (142*c*) corresponding to the third upper principal heat exchange section (136*c*) and the fourth upper principal communicating space (142*d*) corresponding to the fourth upper principal heat exchange section (136*d*).

A third connecting branch pipe (130) connects the third lower principal heat exchange section (236*c*), the fifth upper principal heat exchange section (136*e*) and the sixth upper principal heat exchange section (1360 together. Specifically, in the third connecting branch pipe (130), an opening end of the main portion (131) communicates with the third lower principal communicating space (143*c*), an opening end of one of the branched portions (132*a*) communicates with the fifth upper principal communicating space (142*e*), and an opening end of the other branched portion (132*b*) communicates with the sixth upper principal communicating space (142*f*). Thus, the third lower principal communicating space (143*c*) is connected to both of the fifth upper principal communicating space (142*e*) corresponding to the fifth upper principal heat exchange section (136*e*) and the sixth upper principal communicating space (1420 corresponding to the sixth upper principal heat exchange section (1360.

A space inside the second header collection pipe (70) is divided vertically by a partition plate (71). In the second header collection pipe (70), a space above the partition plate (71) is an upper space (72) and a space below the partition plate (71) is a lower space (73). The upper space (72) is further divided vertically by a partition plate (171). That is, a space above the partition plate (171) is a first upper space (172) and a space below the partition plate (171) is a second upper space (173).

The first upper space (172) communicates with all the flat tubes (31) in the upper principal heat exchange region (135). In other words, in the second header collection pipe (70), the communicating spaces formed in a one-to-one relationship with the heat exchange sections (136*a*-1360 of the upper principal heat exchange region (135) communicate with each other to form the single first upper space (172). A gas connection pipe (102) is connected to a portion of the second header collection pipe (70) forming the first upper space (172). The gas connection pipe (102) is connected to a pipe (18) constituting the refrigerant circuit (20).

On the other hand, the second upper space (173) is divided by two partition plates (174) into three lower principal communicating spaces (173*a*-173*c*). That is, a first lower principal communicating space (173*a*), a second lower principal communicating space (173*b*) and a third lower principal communicating space (173*c*) are provided in this order from bottom to top in the second header collection pipe (70) between the two partition plates (71, 171).

The twelve flat tubes (31) in the first lower principal heat exchange section (236*a*) communicate with the first lower principal communicating space (173*a*). The eleven flat tubes (31) in the second lower principal heat exchange section (236*b*) communicate with second lower principal communicating space (173*b*). The eleven flat tubes (31) in the third lower principal heat exchange section (236*c*) communicate with the third lower principal communicating space (173*c*).

The lower space (73) is divided by two partition plates (76) into three auxiliary communicating spaces (77*a*-77*c*). That is, a first auxiliary communicating space (77*a*), a second auxiliary communicating space (77*b*) and a third auxiliary communicating space (77*c*) are provided in this order from bottom to top in the second header collection pipe (70) below the partition plate (71).

The three flat tubes (31) in the first auxiliary heat exchange section (38*a*) communicate with the first auxiliary communicating space (77*a*). The three flat tubes (31) in the second auxiliary heat exchange section (38*b*) communicate with the second auxiliary communicating space (77*b*). The three flat tubes (31) in the third auxiliary heat exchange section (38*c*) communicate with the third auxiliary communicating space (77*c*).

Three connecting branch pipes (103, 104, 105) are attached to the second header collection pipe (70). A first connecting branch pipe (103) connects the first auxiliary heat exchange section (38*a*) to the first lower principal heat exchange section (236*a*). Specifically, one of opening ends of the first connecting branch pipe (103) communicates with the first auxiliary communicating space (77*a*), and the other opening end communicates with the first lower principal communicating space (173*a*). A second connecting branch pipe (104) connects the second auxiliary heat exchange section (38*b*) to the second lower principal heat exchange section (236*b*). Specifically, one of opening ends of the second connecting branch pipe (104) communicates with the second auxiliary communicating space (77*b*), and the other opening end communicates with the second lower principal communicating space (173*b*). A third connecting branch pipe (105) connects the third auxiliary heat exchange section (38*c*) to the third lower principal heat exchange section (236*c*). Specifically, one of opening ends of the third connecting branch pipe (105) communicates with the third auxiliary communicating space (77*c*) and the other opening end communicates with the third lower principal communicating space (173*c*).

<Refrigerant Flow in Outdoor Heat Exchanger Functioning as Condenser>

During a cooling operation of the air conditioner (10), the outdoor heat exchanger (23) functions as a condenser. A refrigerant flow in the outdoor heat exchanger (23) performing the cooling operation will be described below.

To the outdoor heat exchanger (23), a gas refrigerant discharged from the compressor (21) is supplied through the pipe (18). As illustrated in FIG. 8, the refrigerant supplied to the gas connection pipe (102) through the pipe (18) passes through the upper principal heat exchange sections (136*a*-136*f*) of the upper principal heat exchange region (135), the lower principal heat exchange sections (236*a*-236*c*) of the lower principal heat exchange region (235) and the auxiliary heat exchange sections (38*a*-38*c*) of the auxiliary heat exchange region (37) in this order, and flows into the pipe (17) through the liquid connection pipe (101).

Specifically, a single-phase gas refrigerant that flowed from the gas connection pipe (102) into the first upper space (172) of the second header collection pipe (70) is divided to flow into the flat tubes (31) of each of the upper principal heat exchange sections (136*a*-1360. The refrigerant flowing through the flat tubes (31) of each of the upper principal heat exchange sections (136*a*-1360 exchanges heat with the outdoor air supplied to the outdoor heat exchanger (23).

The refrigerant that passed through the flat tubes (31) of each of the upper principal heat exchange sections (136*a*-136*f*) flows into an associated one of the upper principal communicating spaces (142*a*-142*f*) in the first header collection pipe (40). Flows of the refrigerant that passed through the plurality of flat tubes (31) of the first upper principal heat exchange section (136*a*) enter, and merge together in, the first upper principal communicating space (142*a*). Flows of the refrigerant that passed through the plurality of flat tubes (31) of the second upper principal heat exchange section (136*b*) enter, and merge together in, the second upper principal communicating space (142*b*). Flows of the refrigerant that passed through the plurality of flat tubes (31) of the third upper principal heat exchange section (136*c*) enter, and merge together in, the third upper principal communicating space (142*c*). Flows of the refrigerant that passed through the plurality of flat tubes (31) of the fourth upper principal heat exchange section (136*d*) enter, and merge together in, the fourth upper principal communicating space (142*d*). Flows of the refrigerant that passed through the plurality of flat tubes (31) of the fifth upper principal heat exchange section (136*e*) enter, and merge together in, the fifth upper principal communicating space (142*e*). Flows of the refrigerant that passed through the plurality of flat tubes (31) of the sixth upper principal heat exchange section (1360 enter, and merge together in, the sixth upper principal communicating space (1420.

The refrigerant in the first and second upper principal communicating space (142*a*) and (142*b*) flows into the first lower principal communicating space (143*a*) through the first connecting branch pipe (110). The refrigerant in the third and fourth upper principal communicating spaces (142*c*) and (142*d*) flows into the second lower principal communicating space (143*b*) through the second connecting branch pipe (120). The refrigerant in the fifth and sixth upper principal communicating spaces (142*e*) and (1420 flows into the third lower principal communicating space (143*c*) through the third connecting branch pipe (130).

The refrigerant in each of the lower principal communicating spaces (143*a*-143*c*) flows into the flat tubes (31) of an associated one of the lower principal heat exchange sections (236*a*-236*c*). The refrigerant in the first lower principal communicating space (143*a*) flows into the flat tubes (31) in the first lower principal heat exchange section (236*a*). The refrigerant in the second lower principal communicating space (143*b*) flows into the flat tubes (31) in the second lower principal heat exchange section (236*b*). The refrigerant in the third lower principal communicating space (143*c*) flows into the flat tubes (31) in the third lower principal heat exchange section (236*c*).

The refrigerant flowing through the flat tubes (31) of each of the lower principal heat exchange sections (236*a*-236*c*) exchanges heat with the outdoor air supplied to the outdoor heat exchanger (23). The refrigerant that passed through the flat tubes (31) of each of the lower principal heat exchange sections (236*a*-236*c*) flows into an associated one of the lower principal communicating spaces (173*a*-173*c*) in the second header collection pipe (70). Flows of the refrigerant that passed through the plurality of flat tubes (31) of the first lower principal heat exchange section (236*a*) enter, and merge together in, the first lower principal communicating space (173*a*). Flows of the refrigerant that passed through the plurality of flat tubes (31) of the second lower principal heat exchange section (236*b*) enter, and merge together in, the second lower principal communicating space (173*b*). Flows of the refrigerant that passed through the plurality of flat tubes (31) of the third lower principal heat exchange section (236*c*) enter, and merge together in, the third lower principal communicating space (173*c*).

The refrigerant in the first lower principal communicating space (173*a*) flows into the first auxiliary communicating space (77*a*) through the first connecting branch pipe (103). The refrigerant in the second lower principal communicating space (173*b*) flows into the second auxiliary communicating space (77*b*) through the second connecting branch pipe (104). The refrigerant in the third lower principal communicating space (173*c*) flows into the third auxiliary communicating space (77*c*) through the third connecting branch pipe (105).

The refrigerant in each of the auxiliary communicating spaces (77*a*-77*c*) flows into the flat tubes (31) in an associated one of the auxiliary heat exchange sections (38*a*-38*c*). The refrigerant in the first auxiliary communicating space (77*a*) flows into the flat tubes (31) in the first auxiliary heat exchange section (38*a*). The refrigerant in the second auxiliary communicating space (77*b*) flows into the flat tubes (31) in the second auxiliary heat exchange section (38*b*). The refrigerant in the third auxiliary communicating space (77*c*) flows into the flat tubes (31) in the third auxiliary heat exchange section (38*c*).

The refrigerant flowing through the flat tubes (31) of each of the auxiliary heat exchange sections (38*a*-38*c*) exchange heat with the outdoor air supplied to the outdoor heat exchanger (23). The refrigerant that passed through the flat tubes (31) of each of the auxiliary heat exchange sections (38*a*-38*c*) flows into an associated one of the communicating chambers (151-153). Flows of the refrigerant that passed through the plurality of flat tubes (31) of the first auxiliary heat exchange section (38*a*) enter, and merge together in, the first communicating chamber (151). Flows of the refrigerant that passed through the plurality of flat tubes (31) of the second auxiliary heat exchange section (38*b*) enter, and merge together in, the second communicating chamber (152). Flows of the refrigerant that passed through the plurality of flat tubes (31) of the third auxiliary heat exchange section (38*c*) enter, and merge together in, the third communicating chamber (153). Flows of the refrigerant coming from the communicating chambers (151-153) enter, and merge together in, the mixing chamber (154), and the merged refrigerant flows out of the outdoor heat exchanger (23) through the liquid connection pipe (101).

<Refrigerant Flow in Outdoor Heat Exchanger Functioning as an Evaporator>

During a heating operation of the air conditioner (10), the outdoor heat exchanger (23) functions as an evaporator. A refrigerant flow in the outdoor heat exchanger (23) performing the heating operation will be described below.

The refrigerant expanded in passing through the expansion valve (24) and turned into a gas-liquid two-phase refrigerant is supplied to the outdoor heat exchanger (23) through the pipe (17). As illustrated in FIG. 9, the refrigerant supplied from the pipe (17) to the liquid connection pipe (101) passes through the auxiliary heat exchange sections (38*a*-38*c*) of the auxiliary heat exchange region (37), the lower principal heat exchange sections (236*a*-236*c*) of the lower principal heat exchange region (235) and the upper principal heat exchange sections (136*a*-136*f*) of the upper principal heat exchange region (135) in this order, and then flows into the pipe (18) through the gas connection pipe (102).

Specifically, the gas-liquid two-phase refrigerant flowed from the liquid connection pipe (101) to the mixing chamber (154) is distributed to the three communicating chambers (151-153) so that the refrigerant flows into the flat tubes (31) of the auxiliary heat exchange sections (38*a*-38*c*) corresponding respectively to the communicating chambers (151-153). The refrigerant flowing through the flat tubes (31) of each of the auxiliary heat exchange sections (38*a*-38*c*) exchanges heat with the outdoor air supplied to the outdoor heat exchanger (23). Flows of the refrigerant that passed through the three flat tubes (31) of each of the auxiliary heat exchange sections (38*a*-38*c*) enter, and merge together in, the auxiliary communicating space (77*a*-77*c*) in the second header collection pipe (70) corresponding to each of the auxiliary heat exchange sections (38*a*-38*c*).

The refrigerant in the first auxiliary communicating space (77*a*) flows into the first lower principal communicating space (173*a*) through the first connecting branch pipe (103). The refrigerant in the second auxiliary communicating space (77*b*) flows into the second lower principal communicating space (173*b*) through the second connecting branch pipe (104). The refrigerant in the third auxiliary communicating space (77*c*) flows into the third lower principal communicating space (173*c*) through the third connecting branch pipe (105).

The refrigerant in each of the lower principal communicating spaces (173*a*-173*c*) flows into the flat tubes (31) in an associated one of the lower principal heat exchange sections (236*a*-236*c*). The refrigerant in the first lower principal communicating space (173*a*) flows into the flat tubes (31) in the first lower principal heat exchange section (236*a*). The refrigerant in the second lower principal communicating space (173*b*) flows into the flat tubes (31) in the second lower principal heat exchange section (236*b*). The refrigerant in the third lower principal communicating space (173*c*) flows into the flat tubes (31) in the third lower principal heat exchange section (236*c*).

The refrigerant flowing through the flat tubes (31) in each of the lower principal heat exchange sections (236*a*-236*c*) exchanges heat with the outdoor air supplied to the outdoor heat exchanger (23). The refrigerant that passed through the flat tubes (31) of each of the lower principal heat exchange sections (236*a*-236*c*) flows into an associated one of the lower principal communicating spaces (143*a*-143*c*) in the first header collection pipe (40). Flows of the refrigerant that passed through the plurality of flat tubes (31) of the first lower principal heat exchange section (236*a*) enter, and merge together in, the first lower principal communicating space (143*a*). Flows of the refrigerant that passed through the plurality of flat tubes (31) of the second lower principal heat exchange section (236*b*) enter, and merge together in, the second lower principal communicating space (143*b*). Flows of the refrigerant that passed through the plurality of flat tubes (31) of the third lower principal heat exchange section (236*c*) enter, and merge together in, the third lower principal communicating space (143*c*).

A portion of the refrigerant that flowed from the first lower principal communicating space (143*a*) to the main portion (111) of the first connecting branch pipe (110) flows into the first upper principal communicating space (142*a*) through one of the branched portions (112*a*), and the rest of the refrigerant flows into the second upper principal communicating space (142*b*) through the other branched portion (112*b*). A portion of the refrigerant that flowed from the second lower principal communicating space (143*b*) to the main portion (121) of the second connecting branch pipe (120) flows into the third upper principal communicating space (142*c*) through one of the branched portions (122*a*), and the rest of the refrigerant flows into the fourth upper principal communicating space (142*d*) through the other branched portion (122*b*). A portion of the refrigerant that flowed from the third lower principal communicating space (143*c*) to the main portion (131) of the third connecting branch pipe (130) flows into the fifth upper principal communicating space (142*e*) through one of the branched portions (132*a*), and the rest of the refrigerant flows into the sixth upper principal communicating space (1420 through the other branched portion (132*b*).

The refrigerant that flowed into each of the upper principal communicating spaces (142*a*-1420 in the first header collection pipe (40) flows into the flat tubes (31) in the upper principal heat exchange section (136*a*-136*f*) corresponding to the upper principal communicating space (142*a*-142*f*). The refrigerant in the first upper principal communicating space (142*a*) flows into the flat tubes (31) in the first upper principal heat exchange section (136*a*). The refrigerant in the second upper principal communicating space (142*b*) flows into the flat tubes (31) in the second upper principal heat exchange section (136*b*). The refrigerant in the third upper principal communicating space (142*c*) flows into the flat tubes (31) in the third upper principal heat exchange section (136*c*). The refrigerant in the fourth upper principal communicating space (142*d*) flows into the flat tubes (31) in the fourth upper principal heat exchange section (136*d*). The refrigerant in the fifth upper principal communicating space (142*e*) flows into the flat tubes (31) in the fifth upper principal heat exchange section (136*e*). The refrigerant in the sixth upper principal communicating space (1420 flows into the flat tubes (31) in the sixth upper principal heat exchange section (1360.

The refrigerant flowing through the flat tubes (31) in each of the upper principal heat exchange sections (136*a*-136*f*) exchanges heat with the outdoor air supplied to the outdoor heat exchanger (23). Flows of the refrigerant that passed through the plurality of flat tubes (31) of each of the upper principal heat exchange sections (136*a*-1360 enter, and merge together in, the first upper space (172) in the second header collection pipe (70), and the merged refrigerant flows out of the outdoor heat exchanger (23) through the gas connection pipe (102).

In the foregoing configuration of the second embodiment, the auxiliary heat exchange region (37), the lower principal heat exchange region (235) and the upper principal heat exchange region (135) are connected in series when the outdoor heat exchanger (23) functions as an evaporator, and the number of the heat exchange sections (136*a*-1360 of the upper principal heat exchange region (135) is multiple times larger than the number of the heat exchange sections (235*a*-236*c*) of the lower principal heat exchange region (235). That is, when the outdoor heat exchanger (23) functions as an evaporator, the number of the heat exchange sections (136*a*-1360 of the downstream upper principal heat exchange region (135) is six, which is a multiple of the number (three) of the heat exchange sections (236*a*-236*c*) of the upstream lower principal heat exchange region (235).

Advantages of Second Embodiment

The outdoor heat exchanger (23) of the second embodiment is configured such that the number of the heat exchange sections (136*a*-1360 in the most downstream upper principal heat exchange region (135) is larger than the number of the heat exchange sections (38*a*-38*c*) in the most upstream auxiliary heat exchange region (37) when the outdoor heat exchanger (23) functions as an evaporator. In this configuration, the number of communicating spaces (142*a*-142*f*) corresponding to the upper principal heat exchange region (135) increases, and thus the number of flat tubes (31) communicating with each of the communicating spaces (142*a*-142*f*) decreases and the height of each of the communicating spaces (142*a*-142*f*) decreases as compared with the case where the upper principal and auxiliary heat exchange regions (135) and (37) have the same number of heat exchange sections. A drift of the refrigerant occurs most easily in each of the communicating spaces (142*a*-142*f*) corresponding to the most downstream upper principal heat exchange region (135) when the outdoor heat exchanger (23) functions as an evaporator. However, if the height of each of the communicating spaces (142*a*-142*f*) corresponding to the upper principal heat exchange region (135) decreases as can be seen in the foregoing, the gas and liquid refrigerants are not separated easily, and the drift of the refrigerant does not occur easily in each of the communicating spaces (142*a*-1420 corresponding to the upper principal heat exchange region (135). Thus, in the outdoor heat exchanger (23) of the second embodiment, the drift of the refrigerant is reducible in each of the communicating spaces (142*a*-1420 corresponding to the most downstream upper principal heat exchange region (135) where the drift of the refrigerant occurs most easily when the outdoor heat exchanger functions as an evaporator. This allows the outdoor heat exchanger (23) to exhibit sufficiently good performance.

When the outdoor heat exchanger (23) functions as an evaporator and the amount of the refrigerant that flowed into the outdoor heat exchanger (23) is small, the drift of the refrigerant occurs easily particularly in the communicating space from which the refrigerant is distributed into the plurality of flat tubes (31). Thus, according to the above-described configuration, the drift of the refrigerant is reducible more significantly even if the amount of the refrigerant that flowed into the outdoor heat exchanger (23) is small. This allows the outdoor heat exchanger (23) to exhibit sufficiently good performance.

Further, in the outdoor heat exchanger (23) of the second embodiment, the connecting branch pipe (branch pipe) (110, 120, 130) is provided between the lower and upper principal heat exchange regions (235) and (135) connected in series when the outdoor heat exchanger (23) functions as an evaporator so as to connect each of the heat exchange sections (236*a*-236*c*) of the upstream lower principal heat exchange region (235) to the two mutually different heat exchange sections (136*a*-1360 of the downstream upper principal heat exchange region (135). This allows for easy provision of the configuration in which the downstream upper principal heat exchange region (135) has more heat exchange sections than the upstream lower principal heat exchange region (235) when the outdoor heat exchanger (23) functions as an evaporator.

When the outdoor heat exchanger (23) functions as an evaporator, the lower the position of the heat exchange section (38*a*, 136*a*, 236*a*) is in each of the heat exchange regions (37, 135, 235), the more easily the liquid refrigerant flows into that heat exchange section. On the other hand, the height of the communicating space increases as the number of flat tubes (31) communicating with the communicating space increases. Thus, the drift of the refrigerant occurs more easily in a communicating space communicating with a large number of flat tubes (31) than in a communicating space communicating with a small number of flat tubes (31) when the outdoor heat exchanger (23) functions as an evaporator.

Thus, in the outdoor heat exchanger (23) of the second embodiment, if the plurality of heat exchange sections (136*a*-136*f*, 236*a*-236*c*) of the heat exchange region (135, 235) have different numbers of flat tubes (31), the heat exchange section (136*a*, 236*a*) having a larger number of flat tubes (31) and thus causing the drift of the refrigerant easily in the corresponding communicating space (142*a*, 173*a*) when the outdoor heat exchanger (23) functions as an evaporator is arranged at a lower position to which a large amount of liquid refrigerant flows easily. As a result, the drift of the refrigerant in the communicating space (142*a*, 173*a*) is reducible because a large amount of liquid refrigerant flows into the communicating space (142*a*, 173*a*) corresponding to the heat exchange section (136*a*, 236*a*) where the drift of the refrigerant occurs easily when the outdoor heat exchanger (23) functions as an evaporator. This allows the outdoor heat exchanger (23) to exhibit sufficiently good performance.

The outdoor heat exchanger (23) of the second embodiment is configured such that the number of the auxiliary heat exchange sections (78*a*-78*c*) in the auxiliary heat exchange region (37) is the same as the number of the lower principal heat exchange sections (236*a*-236*c*) in the lower principal heat exchange region (235). However, the outdoor heat exchanger (23) of the second embodiment may be configured such that the number of the lower principal heat exchange sections (236*a*-236*c*) in the lower principal heat exchange region (235) is larger than the number of the auxiliary heat exchange sections (78*a*-78*c*) in the auxiliary heat exchange region (37) and that the number of the heat exchange sections gradually increases from the most upstream heat exchange region toward the most downstream heat exchange region when the outdoor heat exchanger (23) functions as an evaporator. For example, the auxiliary heat exchange region (37) may be divided into two auxiliary heat exchange sections, the lower principal heat exchange region (235) may be divided into four lower principal heat exchange sections, and the upper principal heat exchange region (135) may be divided into eight upper principal heat exchange sections. When the outdoor heat exchanger (23) functions as an evaporator, the drift of the refrigerant occurs more easily in the more downstream heat exchange region (135). However, in this configuration, the number of the communicating spaces gradually increases from the most upstream heat exchange region (37) toward the most downstream heat exchange region (135). Thus, the drift of the refrigerant flowing from each of the communicating spaces to the flat tubes (31) is effectively reducible. This allows the outdoor heat exchanger (23) to exhibit sufficiently good performance.

Further, in the outdoor heat exchanger (23) of the second embodiment, the total number of the flat tubes (31) arranged vertically in the heat exchanger unit (30) is significantly larger than that in the outdoor heat exchanger (23) of the first embodiment. Thus, in the outdoor heat exchanger (23) of the second embodiment, the number of the heat exchange regions (37, 135, 235) arranged vertically in the heat exchanger unit (30) is set larger than that in the outdoor heat exchanger (23) of the first embodiment, thereby reducing the total number of the flat tubes (31) arranged in each of the heat exchange regions (37, 135, 235). This reduces the number of the flat tubes (31) arranged in each of the heat exchange sections (38*a*-38*c*, 135*a*-135*f*, 235*a*-235*c*). In such a case where the total number of the flat tubes (31) arranged vertically in the heat exchanger unit (30) is large, the number of vertically arranged heat exchange regions (37, 135, 235) is increased to reduce the number of the flat tubes (31) arranged in each of the heat exchange sections (38*a*-38*c*, 135*a*-135*f*, 235*a*-235*c*), thereby allowing for reducing the height of each of the communicating spaces. As a result, when the outdoor heat exchanger (23) functions as an evaporator, the drift of the refrigerant flowing from each of the communicating spaces to the flat tubes (31) is reducible, thereby allowing the outdoor heat exchanger (23) to exhibit sufficiently good performance.

Third Embodiment of the Invention

Figure 10:
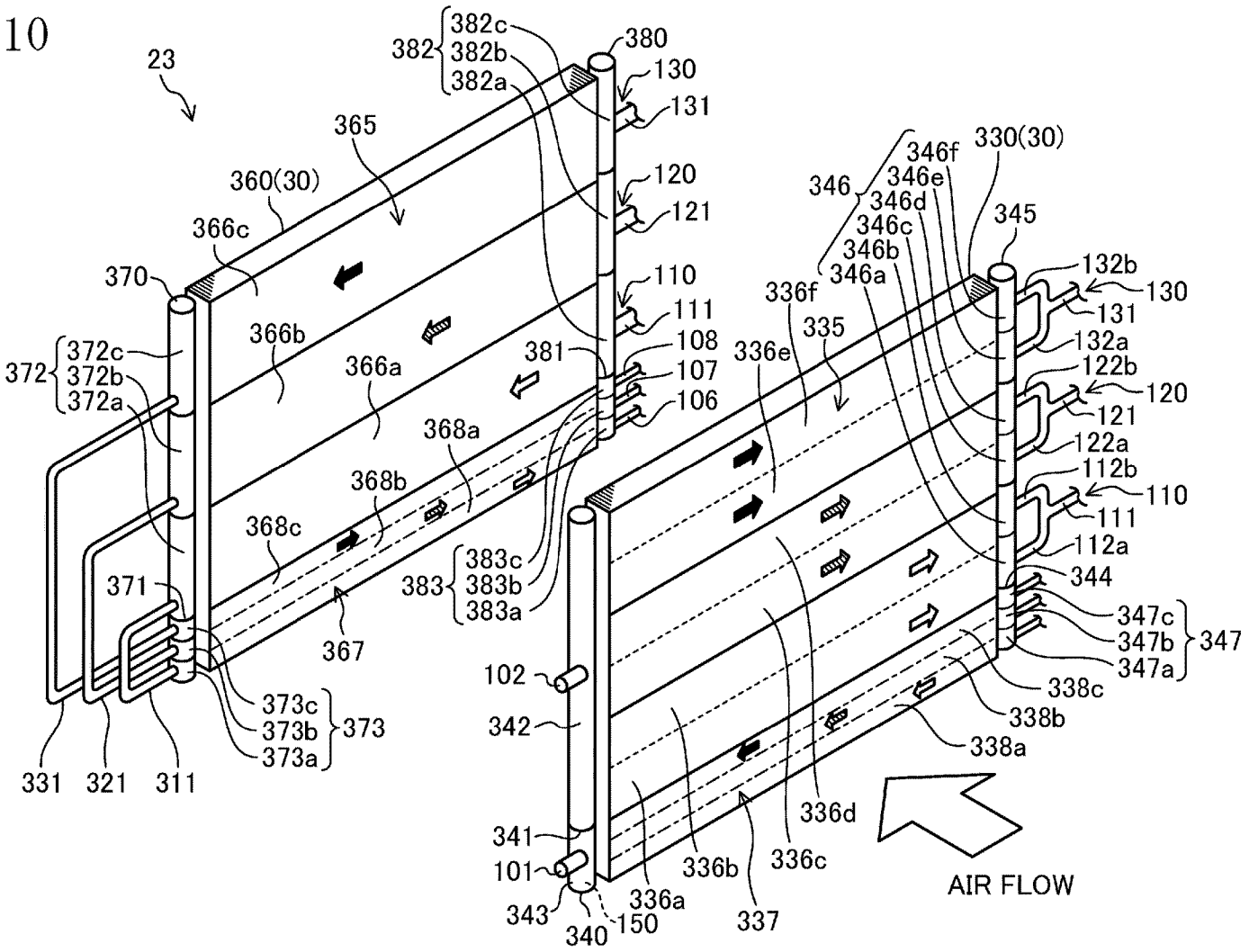
FIG. 10 is a general perspective view of a heat exchanger unit of a third embodiment illustrating how a refrigerant flows when an outdoor heat exchanger functions as a condenser.

A third embodiment of the present invention will be described below. The outdoor heat exchanger (23) of the first embodiment includes a single heat exchanger unit (30). In the third embodiment, as shown in FIG. 10, the outdoor heat exchanger (23) includes two heat exchanger units (30).

Specifically, the outdoor heat exchanger (23) is a double-column air heat exchanger, and includes a windward heat exchanger unit (330) and a leeward heat exchanger unit (360). The windward and leeward heat exchanger units (330) and (360) overlap with each other in a flow direction of the air passing through the outdoor heat exchanger (23). In the flow direction of the air passing through the outdoor heat exchanger (23), the windward heat exchanger unit (330) is arranged upstream of the leeward heat exchanger unit (360).

<Configuration for Windward Heat Exchanger Unit>

The windward heat exchanger unit (330) includes a single first windward header collection pipe (340) and a single second windward header collection pipe (345), and in addition, multiple flat tubes (31) and multiple fins (32) (not shown), both of which being configured in the same manner as those of the first embodiment. The first and second windward header collection pipes (340) and (345), the flat tubes (31) and the fins (32) are aluminum alloy members, and are joined to one another by brazing.

Each of the first and second windward header collection pipes (340) and (345) is a long, narrow cylindrical pipe having closed ends. The first windward header collection pipe (340) is arranged in an upright state on one of the lateral sides of the windward heat exchanger unit (330), and the second windward header collection pipe (345) is arranged in an upright state on the other lateral side of the windward heat exchanger unit (330). That is, the first and second windward header collection pipes (340) and (345) are arranged so that their axial direction extends in the vertical direction.

The plurality of flat tubes (31) in the windward heat exchanger unit (330) are arranged such that their axial direction extend along the lateral direction and flat surfaces of each of the flat tubes face those of adjacent flat tubes. The flat tubes (31) are arranged vertically at regular intervals, and their axial directions are substantially parallel to each other. Each of the flat tubes (31) has an end inserted in the first windward header collection pipe (340) and the other end inserted in the second windward header collection pipe (345). On the other hand, the plurality of fins (32) are arranged at regular intervals in the axial direction of the flat tubes (31).

Figure 11:
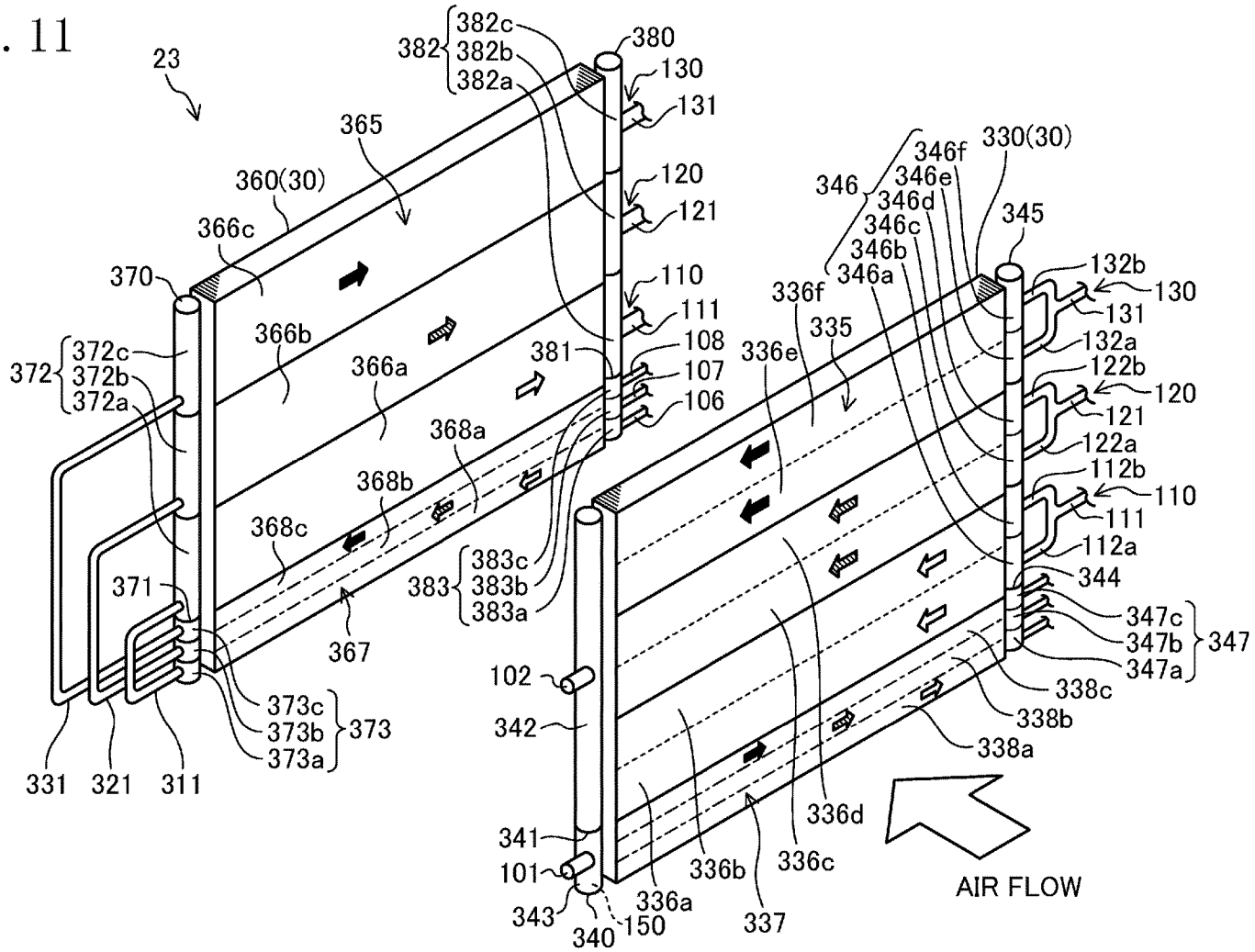
FIG. 11 is a general perspective view of the heat exchanger unit of the third embodiment illustrating how the refrigerant flows when the outdoor heat exchanger functions as an evaporator.

As illustrated in FIGS. 10 and 11, the windward heat exchanger unit (330) is divided into two vertically arranged heat exchange regions (335, 337). The windward heat exchanger unit (330) includes an upper principal windward heat exchange region (335) and a lower auxiliary windward heat exchange region (337).

The principal windward heat exchange region (335) is divided into six vertically arranged principal windward heat exchange sections (336*a*-336*f*). On the other hand, the auxiliary windward heat exchange region (337) is divided into three vertically arranged auxiliary windward heat exchange sections (338*a*-338*c*). The numbers of the principal and auxiliary windward heat exchange sections (336*a*-336*f*) and (338*a*-338*c*) are merely examples.

The principal windward heat exchange region (335) includes a first principal windward heat exchange section (336*a*), a second principal windward heat exchange section (336*b*), a third principal windward heat exchange section (336*c*), a fourth principal windward heat exchange section (336*d*), a fifth principal windward heat exchange section (336*e*) and a sixth principal windward heat exchange section (336*f*) arranged in this order from bottom to top. Although not shown in the drawings, twelve flat tubes (31) are provided in the first principal windward heat exchange section (336*a*), and eleven flat tubes (31) are provided in each of the second to sixth principal windward heat exchange sections (336*b*-336*f*).

The auxiliary windward heat exchange region (337) includes a first auxiliary windward heat exchange section (338*a*), a second auxiliary windward heat exchange section (338*b*) and a third auxiliary windward heat exchange section (338*c*) arranged in this order from bottom to top. Although not shown in the drawings, three flat tubes (31) are provided in each of the auxiliary windward heat exchange sections (338*a*-338*c*).

A space inside the first windward header collection pipe (340) is divided vertically by a partition plate (341). In the first windward header collection pipe (340), a space above the partition plate (341) is an upper space (342) and a space below the partition plate (341) is a lower space (343).

The upper space (342) communicates with all the flat tubes (31) constituting the principal windward heat exchange region (335). That is, in the first windward header collection pipe (340), communicating spaces formed in a one-to-one relationship with the heat exchange sections (336*a*-336*f*) of the principal windward heat exchange region (335) communicate with each other to form the single upper space (342). A gas connection pipe (102) is connected to a portion of the first windward header collection pipe (340) forming the upper space (342). The gas connection pipe (102) is connected to the pipe (18) constituting the refrigerant circuit (20).

A liquid connection pipe (101) is connected to a portion of the first windward header collection pipe (340) forming the lower space (343). The liquid connection pipe (101) is connected to the pipe (17) constituting the refrigerant circuit (20). In the third embodiment, the portion of the first windward header collection pipe (340) forming the lower space (343) constitutes a distributor (150) for distributing a refrigerant into the three auxiliary windward heat exchange sections (338*a*-338*c*). Although not shown in the drawings, the distributor (150) is configured in the same manner as in the first embodiment, and the lower space (343) is divided into three communicating chambers (151-153), a single mixing chamber (154) and two intermediate chambers (155, 156).

A space inside the second windward header collection pipe (345) is divided vertically by a partition plate (344). In the second windward header collection pipe (345), a space above the partition plate (344) is an upper space (346) and a space below the partition plate (344) is a lower space (347).

The upper space (346) is divided by five partition plates into six principal communicating spaces (346*a*-348*f*). That is, a first principal communicating space (346*a*), a second principal communicating space (346*b*), a third principal communicating space (346*c*), a fourth principal communicating space (346*d*), a fifth principal communicating space (346*e*) and a sixth principal communicating space (3460 are provided in this order from bottom to top in the second windward header collection pipe (345) above the partition plate (344).

The twelve flat tubes (31) constituting the first principal windward heat exchange section (336*a*) communicate with the first principal communicating space (346*a*). The eleven flat tubes (31) constituting the second principal windward heat exchange section (336*b*) communicate with the second principal communicating space (346*b*). The eleven flat tubes (31) constituting the third principal windward heat exchange section (336*c*) communicate with the third principal communicating space (346*c*). The eleven flat tubes (31) constituting the fourth principal windward heat exchange section (336*d*) communicate with the fourth principal communicating space (346*d*). Eleven flat tubes (31) constituting the fifth principal windward heat exchange section (336*e*) communicate with the fifth principal communicating space (346*e*). Eleven flat tubes (31) constituting the sixth principal windward heat exchange section (3360 communicate with the sixth principal communicating space (3460.

The lower space (347) is divided by two partition plates into three auxiliary communicating spaces (347*a*-347*c*). That is, a first auxiliary communicating space (347*a*), a second auxiliary communicating space (347*b*) and a third auxiliary communicating space (347*c*) are provided in this order from bottom to top in the second windward header collection pipe (345) below the partition plate (344).

The three flat tubes (31) in the first auxiliary windward heat exchange section (338*a*) communicate with the first auxiliary communicating space (347*a*). The three flat tubes (31) in the second auxiliary windward heat exchange section (338*b*) communicate with the second auxiliary communicating space (347*b*). The three flat tubes (31) in the third auxiliary windward heat exchange section (338*c*) communicate with the third auxiliary communicating space (347*c*).

<Configuration for Leeward Heat Exchanger Unit>

The leeward heat exchanger unit (360) includes a single first leeward header collection pipe (370), a single second leeward header collection pipe (380), and in addition, multiple flat tubes (31) and multiple fins (32) (not shown) configured in the same manner as those of the first embodiment. The first and second leeward header collection pipes (370) and (380), the flat tubes (31) and the fins (32) are aluminum alloy members, and are joined to one another by brazing.

Each of the first and second leeward header collection pipes (370) and (380) is a long, narrow cylindrical pipe having closed ends. The first leeward header collection pipe (370) is arranged in an upright state on one of the lateral sides of the leeward heat exchanger unit (360), and the second leeward header collection pipe (380) is arranged in an upright state on the other lateral side of the leeward heat exchanger unit (360). That is, the first and second leeward header collection pipes (370) and (380) are arranged so that their axial direction extends in the vertical direction.

The plurality of flat tubes (31) in the leeward heat exchanger unit (360) are arranged in the same manner as the flat tubes (31) in the windward heat exchanger unit (330). Each of the vertically arranged flat tubes (31) has an end inserted in the first leeward header collection pipe (370) and the other end inserted in the second leeward header collection pipe (380). On the other hand, the plurality of fins (32) are arranged at regular intervals in the axial direction of the flat tubes (31).

As illustrated in FIGS. 10 and 11, the leeward heat exchanger unit (360) is divided into two vertically arranged heat exchange regions (365, 367). The leeward heat exchanger unit (360) includes an upper principal leeward heat exchange region (365) and a lower auxiliary leeward heat exchange region (367). Although not shown in the drawings, the number of the flat tubes (31) in the principal leeward heat exchange region (365) is the same as that of the flat tubes (31) in the principal windward heat exchange region (335), and the number of the flat tubes (31) in the auxiliary leeward heat exchange region (367) is the same as that of the flat tubes (31) in the auxiliary windward heat exchange region (337).

The principal leeward heat exchange region (365) is divided into three vertically arranged principal leeward heat exchange sections (366*a*-366*c*). The auxiliary leeward heat exchange region (367) is also divided into three vertically arranged auxiliary leeward heat exchange sections (368*a*-368*c*). The numbers of the principal and auxiliary leeward heat exchange sections (366*a*-366*c*) and (368*a*-368*c*) are merely examples.

The principal leeward heat exchange region (365) includes a first principal leeward heat exchange section (366*a*), a second principal leeward heat exchange section (366*b*) and a third principal leeward heat exchange section (366*c*) arranged in this order from bottom to top. Although not shown in the drawings, twenty-three flat tubes (31) are provided in the first principal leeward heat exchange section (366*a*), and twenty-two flat tubes (31) are provided in each of the second and third principal leeward heat exchange sections (366*b*, 366*c*).

The number of the flat tubes (31) in each of the principal leeward heat exchange sections (366*a*-366*c*) is merely an example. However, it is desirable that the number of the flat tubes (31) in the first principal leeward heat exchange section (366*a*) is equal to the sum of the numbers of the flat tubes (31) in the first and second principal windward heat exchange sections (336*a*) and (336*b*), that the number of the flat tubes (31) in the second principal leeward heat exchange section (366*b*) is equal to the sum of the numbers of the flat tubes (31) in the third and fourth principal windward heat exchange sections (336*c*) and (336*d*), and that the number of the flat tubes (31) in the third principal leeward heat exchange section (366*c*) is equal to the sum of the numbers of the flat tubes (31) in the fifth and sixth principal windward heat exchange sections (336*e*) and (3360.

The auxiliary leeward heat exchange region (367) includes a first auxiliary leeward heat exchange section (368*a*), a second auxiliary leeward heat exchange section (368*b*) and a third auxiliary leeward heat exchange section (368*c*) arranged in this order from bottom to top. Although not shown in the drawings, three flat tubes (31) are provided in each of the auxiliary leeward heat exchange sections (368*a*-368*c*).

The numbers of the flat tubes (31) in the auxiliary leeward heat exchange sections (368*a*-368*c*) may be different from each other. Even if the numbers of the flat tubes (31) in the auxiliary leeward heat exchange sections (368*a*-368*c*) are different from each other, it is desirable that the first auxiliary leeward heat exchange section (368*a*) has the same number of flat tubes (31) as the first auxiliary windward heat exchange section (338*a*), that the second auxiliary leeward heat exchange section (368*b*) has the same number of flat tubes (31) as the second auxiliary windward heat exchange section (338*b*), and that the third auxiliary leeward heat exchange section (368*c*) has the same number of flat tubes (31) as the third auxiliary windward heat exchange section (338*c*).

A space inside the first leeward header collection pipe (370) is divided vertically by a partition plate (371). In the first leeward header collection pipe (370), a space above the partition plate (371) is an upper space (372) and a space below the partition plate (371) is a lower space (373).

The upper space (372) is divided by two partition plates into three principal communicating spaces (372*a*-372*c*). That is, a first principal communicating space (372*a*), a second principal communicating space (372*b*) and a third principal communicating space (372*c*) are provided in this order from bottom to top in the first leeward header collection pipe (370) above the partition plate (371).

The twenty-three flat tubes (31) in the first principal leeward heat exchange section (366*a*) communicate with the first principal communicating space (372*a*). The twenty-two flat tubes (31) in the second principal leeward heat exchange section (366*b*) communicate with the second principal communicating space (372*b*). The twenty-two flat tubes (31) in the third principal leeward heat exchange section (366*c*) communicate with the third principal communicating space (372*c*).

The lower space (373) is divided by two partition plates into three auxiliary communicating spaces (373*a*-373*c*). That is, a first auxiliary communicating space (373*a*), a second auxiliary communicating space (373*b*) and a third auxiliary communicating space (373*c*) are provided in this order from bottom to top in the first leeward header collection pipe (370) below the partition plate (371).

The three flat tubes (31) in the first auxiliary leeward heat exchange section (368*a*) communicate with the first auxiliary communicating space (373*a*). The three flat tubes (31) in the second auxiliary leeward heat exchange section (368*b*) communicate with the second auxiliary communicating space (373*b*). The three flat tubes (31) in the third auxiliary leeward heat exchange section (368*c*) communicate with the third auxiliary communicating space (373*c*).

Three connecting pipes (311, 321, 331) are attached to the first leeward header collection pipe (370). A first connecting pipe (311) connects the first auxiliary leeward heat exchange section (368*a*) to the first principal leeward heat exchange section (366*a*). Specifically, the first connecting pipe (311) has one of its opening ends communicating with the first auxiliary communicating space (373*a*) and the other opening end communicating with the first principal communicating space (372*a*). A second connecting pipe (321) connects the second auxiliary leeward heat exchange section (368*b*) to the second principal leeward heat exchange section (366*b*). Specifically, the second connecting pipe (321) has one of its opening end communicating with the second auxiliary communicating space (373*b*) and the other opening end communicating with the second principal communicating space (372*b*). A third connecting pipe (331) connects the third auxiliary leeward heat exchange section (368*c*) to the third principal leeward heat exchange section (366*c*). Specifically, the third connecting pipe (331) has one of its opening ends communicating with the third auxiliary communicating space (373*c*) and the other opening end communicating with the third principal communicating space (372*c*).

A space inside the second leeward header collection pipe (380) is divided vertically by a partition plate (381). In the second leeward header collection pipe (380), a space above the partition plate (381) is an upper space (382) and a space below the partition plate (381) is a lower space (383).

The upper space (382) is divided by two partition plates into three principal communicating spaces (382*a*-382*c*). That is, a first principal communicating space (382*a*), a second principal communicating space (382*b*) and a third principal communicating space (382*c*) are provided in this order from bottom to top in the second leeward header collection pipe (380) above the partition plate (381).

The twenty-three flat tubes (31) in the first principal leeward heat exchange section (366*a*) communicate with the first principal communicating space (382*a*). The twenty-two flat tubes (31) in the second principal leeward heat exchange section (366*b*) communicate with the second principal communicating space (382*b*). The twenty-two flat tubes (31) in the third principal leeward heat exchange section (366*c*) communicate with the third principal communicating space (382*c*).

The lower space (383) is divided by two partition plates into three auxiliary communicating spaces (383*a*-383*c*). That is, a first auxiliary communicating space (383*a*), a second auxiliary communicating space (383*b*) and a third auxiliary communicating space (383*c*) are provided in this order from bottom to top in the second leeward header collection pipe (380) below the partition plate (381).

The three flat tubes (31) in the first auxiliary leeward heat exchange section (368*a*) communicate with the first auxiliary communicating space (383*a*). The three flat tubes (31) in the second auxiliary leeward heat exchange section (368*b*) communicate with the second auxiliary communicating space (383*b*). The three flat tubes (31) in the third auxiliary leeward heat exchange section (368*c*) communicate with the third auxiliary communicating space (383*c*).

<Connection Between Heat Exchanger Units>

Three connecting branch pipes (branch pipes) (110, 120, 130) are attached to the second windward header collection pipe (345), and three connecting pipes (106,107,108) are attached to the second leeward header collection pipe (380). Each of the connecting branch pipes (110, 120, 130) has a single main portion (111, 121, 131) and two branched portions (112*a*, 112*b*, 122*a*, 122*b*, 132*a*, 132*b*) connected to an end of the main portion (111, 121, 131).

The first connecting branch pipe (110) connects the first principal leeward heat exchange section (366*a*), the first principal windward heat exchange section (336*a*) and the second principal windward heat exchange section (336*b*) together. Specifically, in the first connecting branch pipe (110), an opening end of the main portion (111) communicates with the first principal communicating space (382*a*) in the second leeward header collection pipe (380), an opening end of one of the branched portions (112*a*) communicates with the first principal communicating space (346*a*) in the second windward header collection pipe (345), and an opening end of the other branched portion (112*b*) communicates with the second principal communicating space (346*b*) in the second windward header collection pipe (345). Thus, the first principal communicating space (382*a*) in the second leeward header collection pipe (380) is connected to both of the first and second principal communicating spaces (346*a*) and (346*b*) in the second windward header collection pipe (345).

The second connecting branch pipe (120) connects the second principal leeward heat exchange section (366*b*), the third principal windward heat exchange section (336*c*) and the fourth principal windward heat exchange section (336*d*) together. Specifically, in the second connecting branch pipe (120), an opening end of the main portion (121) communicates with the second principal communicating space (382*b*) in the second leeward header collection pipe (380), an opening end of one of the branched portions (122*a*) communicates with the third principal communicating space (346*c*) in the second windward header collection pipe (345), and an opening end of the other branched portion (122*b*) communicates with the fourth principal communicating space (346*d*) in the second windward header collection pipe (345). Thus, the second principal communicating space (382*b*) in the second leeward header collection pipe (380) is connected to both of the third and fourth principal communicating spaces (346*c*) and (346*d*) in the second windward header collection pipe (345).

The third connecting branch pipe (130) connects the third principal leeward heat exchange section (366*c*), the fifth principal windward heat exchange section (336*e*) and the sixth principal windward heat exchange section (336*f*) together. Specifically, in the third connecting branch pipe (130), an opening end of the main portion (131) communicates with the third principal communicating space (382*c*) in the second leeward header collection pipe (380), an opening end of one of the branched portions (132*a*) communicates with the fifth principal communicating space (346*e*) in the second windward header collection pipe (345), and an opening end of the other branched portion (132*b*) communicates with the sixth principal communicating space (3460 in the second windward header collection pipe (345). Thus, the third principal communicating space (382*c*) in the second leeward header collection pipe (380) is connected to both of the fifth and sixth principal communicating spaces (346*e*) and (3460 in the second windward header collection pipe (345).

The first connecting pipe (106) connects the first auxiliary windward heat exchange section (338*a*) to the first auxiliary leeward heat exchange section (368*a*). Specifically, the first connecting pipe (106) has one of its opening ends communicating with the first auxiliary communicating space (347*a*) in the second windward header collection pipe (345), and the other opening end communicating with the first auxiliary communicating space (383*a*) in the second leeward header collection pipe (380). The second connecting pipe (107) connects the second auxiliary windward heat exchange section (338*b*) to the second auxiliary leeward heat exchange section (368*b*). Specifically, the second connecting pipe (107) has one of its opening ends communicating with the second auxiliary communicating space (347*b*) in the second windward header collection pipe (345), and the other opening end communicating with the second auxiliary communicating space (383*b*) in the second leeward header collection pipe (380). The third connecting pipe (108) connects the third auxiliary windward heat exchange section (338*c*) to the third auxiliary leeward heat exchange section (368*c*). Specifically, the third connecting pipe (108) has one of its opening ends communicating with the third auxiliary communicating space (347*c*) in the second windward header collection pipe (345), and the other opening end communicating with the third auxiliary communicating space (383*c*) in the second leeward header collection pipe (380).

<Refrigerant Flow in Outdoor Heat Exchanger Functioning as Condenser>

During a cooling operation of the air conditioner (10), the outdoor heat exchanger (23) functions as a condenser. A refrigerant flow in the outdoor heat exchanger (23) performing the cooling operation will be described below.

To the outdoor heat exchanger (23), a gas refrigerant discharged from the compressor (21) is supplied through the pipe (18). As illustrated in FIG. 10, the refrigerant supplied to the gas connection pipe (102) through the pipe (18) passes through the principal windward heat exchange sections (336*a*-336*f*) of the principal windward heat exchange region (335), the principal leeward heat exchange sections (366*a*-366*c*) of the principal leeward heat exchange region (365), the auxiliary leeward heat exchange sections (368*a*-368*c*) of the auxiliary leeward heat exchange region (367), and the auxiliary windward heat exchange sections (338*a*-338*c*) of the auxiliary windward heat exchange region (337) in this order, and flows into the pipe (17) through the liquid connection pipe (101).

Specifically, a single-phase gas refrigerant that flowed from the gas connection pipe (102) into the upper space (342) of the first windward header collection pipe (340) is divided to flow into the flat tubes (31) of each of the principal windward heat exchange sections (336*a*-336*f*). The refrigerant flowing through the flat tubes (31) of each of the principal windward heat exchange sections (336*a*-336*f*) exchanges heat with the outdoor air supplied to the outdoor heat exchanger (23).

The refrigerant that passed through the flat tubes (31) of each of the principal windward heat exchange sections (336*a*-3360 flows into an associated one of the principal communicating spaces (346*a*-346*f*) in the second windward header collection pipe (345). Flows of the refrigerant that passed through the plurality of flat tubes (31) of the first principal windward heat exchange section (336*a*) enter, and merge together in, the first principal communicating space (346*a*). Flows of the refrigerant that passed through the plurality of flat tubes (31) of the second principal windward heat exchange section (336*b*) enter, and merge together in, the second principal communicating space (346*b*). Flows of the refrigerant that passed through the plurality of flat tubes (31) of the third principal windward heat exchange section (336*c*) enter, and merge together in, the third principal communicating space (346*c*). Flows of the refrigerant that passed through the plurality of flat tubes (31) of the fourth principal windward heat exchange section (336*d*) enter, and merge together in, the fourth principal communicating space (346*d*). Flows of the refrigerant that passed through the plurality of flat tubes (31) of the fifth principal windward heat exchange section (336*e*) enter, and merge together in, the fifth principal communicating space (346*e*). Flows of the refrigerant that passed through the plurality of flat tubes (31) of the sixth principal windward heat exchange section (3360 enter, and merge together in, the sixth principal communicating space (3460.

The refrigerant in the first and second principal communicating spaces (346*a*) and (346*b*) of the second windward header collection pipe (345) flows into the first principal communicating space (382*a*) in the second leeward header collection pipe (380) through the first connecting branch pipe (110). The refrigerant in the third and fourth principal communicating spaces (346*c*) and (346*d*) of the second windward header collection pipe (345) flows into the second principal communicating space (382*b*) in the second leeward header collection pipe (380) through the second connecting branch pipe (120). The refrigerant in the fifth and sixth principal communicating spaces (346*e*) and (3460 of the second windward header collection pipe (345) flows into the third principal communicating space (382*c*) of the second leeward header collection pipe (380) through the third connecting branch pipe (130).

The refrigerant in each of the principal communicating spaces (382*a*-382*c*) flows into the flat tubes (31) in an associated one of the principal leeward heat exchange sections (366*a*-366*c*). The refrigerant in the first principal communicating space (382*a*) flows into the flat tubes (31) in the first principal leeward heat exchange section (366*a*). The refrigerant in the second principal communicating space (382*b*) flows into the flat tubes (31) in the second principal leeward heat exchange section (366*b*). The refrigerant in the third principal communicating space (382*c*) flows into the flat tubes (31) in the third principal leeward heat exchange section (366*c*).

The refrigerant flowing through the flat tubes (31) of each of the principal leeward heat exchange sections (366*a*-366*c*) exchanges heat with the outdoor air that passed through the principal windward heat exchange region (335). The refrigerant that passed through the flat tubes (31) of each of the principal leeward heat exchange sections (366*a*-366*c*) flows into an associated one of the principal communicating spaces (372*a*-372*c*) in the first leeward header collection pipe (370). Flows of the refrigerant that passed through the plurality of flat tubes (31) of the first principal leeward heat exchange section (366*a*) enter, and merge together in, the first principal communicating space (372*a*). Flows of the refrigerant that passed through the plurality of flat tubes (31) of the second principal leeward heat exchange section (366*b*) enter, and merge together in, the second principal communicating space (372*b*). Flows of the refrigerant that passed through the plurality of flat tubes (31) of the third principal leeward heat exchange section (366*c*) enter, and merge together in, the third principal communicating space (372*c*).

The refrigerant in the first principal communicating space (372*a*) flows into the first auxiliary communicating space (373*a*) through the first connecting pipe (311). The refrigerant in the second principal communicating space (372*b*) flows into the second auxiliary communicating space (373*b*) through the second connecting pipe (321). The refrigerant in the third principal communicating space (372*c*) flows into the third auxiliary communicating space (373*c*) through the third connecting pipe (331).

The refrigerant in each of the auxiliary communicating spaces (373*a*-373*c*) flows into the flat tubes (31) in an associated one of the auxiliary leeward heat exchange sections (368*a*-368*c*). The refrigerant in the first auxiliary communicating space (373*a*) flows into the flat tubes (31) in the first auxiliary leeward heat exchange section (368*a*). The refrigerant in the second auxiliary communicating space (373*b*) flows into the flat tubes (31) in the second auxiliary leeward heat exchange section (368*b*). The refrigerant in the third auxiliary communicating space (373*c*) flows into the flat tubes (31) in the third auxiliary leeward heat exchange section (368*c*).

The refrigerant flowing through the flat tubes (31) of each of the auxiliary leeward heat exchange sections (368*a*-368*c*) exchanges heat with the outdoor air that passed through the auxiliary windward heat exchange region (337). The refrigerant that passed through the flat tubes (31) of each of the auxiliary leeward heat exchange sections (368*a*-368*c*) flows into an associated one of the auxiliary communicating spaces (383*a*-383*c*) in the second leeward header collection pipe (380). Flows of the refrigerant that passed through the plurality of flat tubes (31) of the first auxiliary leeward heat exchange section (368*a*) enter, and merge together in, the first auxiliary communicating space (383*a*). Flows of the refrigerant that passed through the plurality of flat tubes (31) of the second auxiliary leeward heat exchange section (368*b*) enter, and merge together in, the second auxiliary communicating space (383*b*). Flows of the refrigerant that passed through the plurality of flat tubes (31) of the third auxiliary leeward heat exchange section (368*c*) enter, and merge together in, the third auxiliary communicating space (383*c*).

The refrigerant in the first auxiliary communicating space (383*a*) of the second leeward header collection pipe (380) flows into the first auxiliary communicating space (347*a*) of the second windward header collection pipe (345) through the first connecting pipe (106). The refrigerant in the second auxiliary communicating space (383*b*) of the second leeward header collection pipe (380) flows into the second auxiliary communicating space (347*b*) of the second windward header collection pipe (345) through the second connecting pipe (107). The refrigerant in the third auxiliary communicating space (383*c*) of the second leeward header collection pipe (380) flows into the third auxiliary communicating space (347*c*) of the second windward header collection pipe (345) through the third connecting pipe (108).

The refrigerant in each of the auxiliary communicating spaces (347*a*-347*c*) flows into the flat tubes (31) in an associated one of the auxiliary windward heat exchange sections (338*a*-338*c*). The refrigerant in the first auxiliary communicating space (347*a*) flows into the flat tubes (31) in the first auxiliary windward heat exchange section (338*a*). The refrigerant in the second auxiliary communicating space (347*b*) flows into the flat tubes (31) in the second auxiliary windward heat exchange section (338*b*). The refrigerant in the third auxiliary communicating space (347*c*) flows into the flat tubes (31) in the third auxiliary windward heat exchange section (338*c*).

The refrigerant flowing through the flat tubes (31) of each of the auxiliary windward heat exchange sections (338*a*-338*c*) exchanges heat with the outdoor air supplied to the outdoor heat exchanger (23). The refrigerant that passed through the flat tubes (31) of each of the auxiliary windward heat exchange sections (338*a*-338*c*) flows into an associated one of the communicating chambers (151-153). Flows of the refrigerant that passed through the plurality of flat tubes (31) of the first auxiliary windward heat exchange section (338*a*) enter, and merge together in, the first communicating chamber (151). Flows of the refrigerant that passed through the plurality of flat tubes (31) of the second auxiliary windward heat exchange section (338*b*) enter, and merge together in, the second communicating chamber (152). Flows of the refrigerant that passed through the plurality of flat tubes (31) of the third auxiliary windward heat exchange section (338*c*) enter, and merge together in, the third communicating chamber (153). Flows of the refrigerants from the communicating chambers (151-153) enter, and merge together in, the mixing chamber (154), and the merged refrigerant flows out of the outdoor heat exchanger (23) through the liquid connection pipe (101).

<Refrigerant Flow in Outdoor Heat Exchanger Functioning as Evaporator>

During a heating operation of the air conditioner (10), the outdoor heat exchanger (23) functions as an evaporator. A refrigerant flow in the outdoor heat exchanger (23) performing the heating operation will be described below.

The refrigerant expanded in passing through the expansion valve (24) and turned into a gas-liquid two-phase refrigerant is supplied to the outdoor heat exchanger (23) through the pipe (17). As illustrated in FIG. 11, the refrigerant supplied from the pipe (17) to the liquid connection pipe (101) passes through the auxiliary windward heat exchange sections (338*a*-338*c*) of the auxiliary windward heat exchange region (337), the auxiliary leeward heat exchange sections (368*a*-368*c*) of the auxiliary leeward heat exchange region (367), the principal leeward heat exchange sections (366*a*-366*c*) of the principal leeward heat exchange region (365), and the principal windward heat exchange sections (336*a*-336*f*) of the principal windward heat exchange region (335) in this order, and then flows into the pipe (18) through the gas connection pipe (102).

Specifically, the gas-liquid two-phase refrigerant flowed from the liquid connection pipe (101) to the lower space (343) of the first windward header collection pipe (340) is distributed to the three communicating chambers (151-153) so that the refrigerant flows into the flat tubes (31) of the auxiliary windward heat exchange sections (338*a*-338*c*) corresponding respectively to the communicating chambers (151-153). The refrigerant flowing through the flat tubes (31) of the auxiliary windward heat exchange sections (338*a*-338*c*) exchanges heat with the outdoor air supplied to the outdoor heat exchanger (23). The refrigerant that passed through the flat tubes (31) of each of the auxiliary windward heat exchange sections (338*a*-338*c*) flows into an associated one of the auxiliary communicating spaces (347*a*-347*c*) in the second windward header collection pipe (345). Flows of the refrigerant that passed through the plurality of flat tubes (31) of the first auxiliary windward heat exchange section (338*a*) enter, and merge together in, the first auxiliary communicating space (347*a*). Flows of the refrigerant that passed through the plurality of flat tubes (31) of the second auxiliary windward heat exchange section (338*b*) enter, and merge together in, the second auxiliary communicating space (347*b*). Flows of the refrigerant that passed through the plurality of flat tubes (31) of the third auxiliary windward heat exchange section (338*c*) enter, and merge together in, the third auxiliary communicating space (347*c*).

The refrigerant in the first auxiliary communicating space (347*a*) of the second windward header collection pipe (345) flows into the first auxiliary communicating space (383*a*) in the second leeward header collection pipe (380) through the first connecting pipe (106). The refrigerant in the second auxiliary communicating space (347*b*) of the second windward header collection pipe (345) flows into the second auxiliary communicating space (383*b*) in the second leeward header collection pipe (380) through the second connecting pipe (107). The refrigerant in the third auxiliary communicating space (347*c*) of the second windward header collection pipe (345) flows into the third auxiliary communicating space (383*c*) in the second leeward header collection pipe (380) through the third connecting pipe (108).

The refrigerant in each of the auxiliary communicating spaces (383*a*-383*c*) flows into the flat tubes (31) of an associated one of the auxiliary leeward heat exchange sections (368*a*-368*c*). The refrigerant in the first auxiliary communicating space (383*a*) flows into the flat tubes (31) in the first auxiliary leeward heat exchange section (368*a*). The refrigerant in the second auxiliary communicating space (383*b*) flows into the flat tubes (31) in the second auxiliary leeward heat exchange section (368*b*). The refrigerant in the third auxiliary communicating space (383*c*) flows into the flat tubes (31) in the third auxiliary leeward heat exchange section (368*c*).

The refrigerant flowing through the flat tubes (31) in each of the auxiliary leeward heat exchange sections (368*a*-368*c*) exchanges heat with the outdoor air that passed through the auxiliary windward heat exchange region (337). Flows of the refrigerant that passed through the three flat tubes (31) in each of the auxiliary leeward heat exchange sections (368*a*-368*c*) enter, and merge together in, the auxiliary communicating space (373*a*-373*c*) in the first leeward header collection pipe (370) corresponding to the auxiliary leeward heat exchange section (368*a*-368*c*).

The refrigerant in the first auxiliary communicating space (373*a*) flows into the first principal communicating space (372*a*) through the first connecting pipe (311). The refrigerant in the second auxiliary communicating space (373*b*) flows into the second principal communicating space (372*b*) through the second connecting pipe (321). The refrigerant in the third auxiliary communicating space (373*c*) flows into the third principal communicating space (372*c*) through the third connecting pipe (331).

The refrigerant that flowed into each of the principal communicating spaces (372*a*-372*c*) of the first leeward header collection pipe (370) is distributed into the plurality of flat tubes (31) in the principal leeward heat exchange section (366*a*-366*c*) corresponding to the principal communicating space (372*a*-372*c*). The refrigerant in the first principal communicating space (372*a*) flows into the flat tubes (31) constituting the first principal leeward heat exchange section (366*a*). The refrigerant in the second principal communicating space (372*b*) flows into the flat tubes (31) constituting the second principal leeward heat exchange section (366*b*). The refrigerant in the third principal communicating space (372*c*) flows into the flat tubes (31) constituting the third principal leeward heat exchange section (366*c*).

The refrigerant flowing through the flat tubes (31) in each of the principal leeward heat exchange sections (366*a*-366*c*) exchanges heat with the outdoor air that passed through the principal windward heat exchange region (335). The refrigerant that passed through the flat tubes (31) in each of the principal leeward heat exchange sections (366*a*-366*c*) flows into an associated one of the principal communicating spaces (382*a*-382*c*) in the second leeward header collection pipe (380). Flows of the refrigerant that passed through the plurality of flat tubes (31) of the first principal leeward heat exchange section (366*a*) enter, and merge together in, the first principal communicating space (382*a*). Flows of the refrigerant that passed through the plurality of flat tubes (31) of the second principal leeward heat exchange section (366*b*) enter, and merge together in, the second principal communicating space (382*b*). Flows of the refrigerant that passed through the plurality of flat tubes (31) of the third principal leeward heat exchange section (366*c*) enter, and merge together in, the third principal communicating space (382*c*).

A portion of the refrigerant that flowed from the first principal communicating space (382*a*) in the second leeward header collection pipe (380) into the main portion (111) of the first connecting branch pipe (110) flows into the first principal communicating space (346*a*) of the second windward header collection pipe (345) through one of the branched portions (112*a*), and the rest of the refrigerant flows into the second principal communicating space (346*b*) of the second windward header collection pipe (345) through the other branched portion (112*b*). A portion of the refrigerant that flowed from the second principal communicating space (382*b*) of the second leeward header collection pipe (380) into the main portion (121) of the second connecting branch pipe (120) flows into the third principal communicating space (346*c*) of the second windward header collection pipe (345) through one of the branched portions (122*a*), and the rest of the refrigerant flows into the fourth principal communicating space (346*d*) through the other branched portion (122*b*). The refrigerant that flowed from the third principal communicating space (382*c*) of the second leeward header collection pipe (380) into the main portion (131) of the third connecting branch pipe (130) flows into the fifth principal communicating space (346*e*) of the second windward header collection pipe (345) through one of the branched portions (132*a*), and the rest of the refrigerant flows into the sixth principal communicating space (3460 of the second windward header collection pipe (345) through the other branched portion (132*b*).

The refrigerant in each of the principal communicating spaces (346*a*-346*f*) flows into the flat tubes (31) in an associated one of the principal windward heat exchange sections (336*a*-336*f*). The refrigerant in the first principal communicating space (346*a*) flows into the flat tubes (31) in the first principal windward heat exchange section (336*a*). The refrigerant in the second principal communicating space (346*b*) flows into the flat tubes (31) in the second principal windward heat exchange section (336*b*). The refrigerant in the third principal communicating space (346*c*) flows into the flat tubes (31) in the third principal windward heat exchange section (336*c*). The refrigerant in the fourth principal communicating space (346*d*) flows into the flat tubes (31) in the fourth principal windward heat exchange section (336*d*). The refrigerant in the fifth principal communicating space (346*e*) flows into the flat tubes (31) in the fifth principal windward heat exchange section (336*e*). The refrigerant in the sixth principal communicating space (3460 flows into the flat tubes (31) in the sixth principal windward heat exchange section (3360.

The refrigerant flowing through the flat tubes (31) in each of the principal windward heat exchange sections (336*a*-3360 exchanges heat with the outdoor air supplied to the outdoor heat exchanger (23). Flows of the refrigerant that passed through the plurality of flat tubes (31) of each of the principal windward heat exchange sections (336*a*-336*f*) enter, and merge together in, the upper space (342) of the first windward header collection pipe (340), and then the merged refrigerant flows out of the outdoor heat exchanger (23) through the gas connection pipe (102).

In the foregoing configuration according to the third embodiment, the auxiliary windward heat exchange region (337), the auxiliary leeward heat exchange region (367), the principal leeward heat exchange region (365) and the principal windward heat exchange region (335) are connected in series when the outdoor heat exchanger (23) functions as an evaporator, and the number of the heat exchange sections (336*a*-336*f*) of the principal windward heat exchange region (335) is multiple times larger than the number of the heat exchange sections (366*a*-366*c*) of the heat exchange regions (365). That is, when the outdoor heat exchanger (23) functions as an evaporator, the number of the heat exchange sections (336*a*-3360 of the downstream principal windward heat exchange region (335) is six, which is a multiple of the number (three) of the heat exchange sections (366*a*-366*c*) of the upstream principal leeward heat exchange region (365).

Advantages of Third Embodiment

The outdoor heat exchanger (23) of the third embodiment is configured such that the number of the heat exchange sections (336*a*-336*f*) in the most downstream principal windward heat exchange region (335) is larger than the number of the heat exchange sections (338*a*-338*c*) in the most upstream auxiliary windward heat exchange region (337) when the outdoor heat exchanger (23) functions as an evaporator. In this configuration, the number of communicating spaces (346*a*-3460 corresponding to the principal windward heat exchange region (335) increases, and thus the number of flat tubes (31) communicating with each of the communicating spaces (346*a*-346*f*) decreases and the height of each of the communicating spaces (346*a*-346*f*) decreases as compared with the case where the principal and auxiliary windward heat exchange regions (335) and (337) have the same number of heat exchange sections. A drift of the refrigerant occurs most easily in each of the communicating spaces (346*a*-346*f*) corresponding to the most downstream principal windward heat exchange region (335) when the outdoor heat exchanger (23) functions as an evaporator. However, if the height of each of the communicating spaces (346*a*-346*f*) corresponding to the principal windward heat exchange region (335) decreases as can be seen in the foregoing, the gas and liquid refrigerants are not separated easily, and the drift of the refrigerant does not occur easily. Thus, in the outdoor heat exchanger (23) of the third embodiment, the drift of the refrigerant is reducible in each of the communicating spaces (346*a*-3461) corresponding to the most downstream principal windward heat exchange region (335) where the drift of the refrigerant occurs most easily when the outdoor heat exchanger (23) functions as an evaporator, is reducible. This allows the outdoor heat exchanger (23) to exhibit sufficiently good performance.

When the outdoor heat exchanger (23) functions as an evaporator and the amount of the refrigerant that flowed into the outdoor heat exchanger (23) is small, the drift of the refrigerant occurs easily particularly in the communicating space from which the refrigerant is distributed into the plurality of flat tubes (31). Thus, according to the above-described configuration, the drift of the refrigerant is reducible more significantly even if the amount of the refrigerant that flowed into the outdoor heat exchanger (23) is small. This allows the outdoor heat exchanger (23) to exhibit sufficiently good performance.

Further, in the outdoor heat exchanger (23) of the third embodiment, the connecting branch pipe (branch pipe) (110, 120, 130) is provided between the principal leeward heat exchange region (365) and the principal windward heat exchange region (335) connected to each other in series when the outdoor heat exchanger (23) functions as an evaporator so as to connect each of the heat exchange sections (366*a*-366*c*) of the upstream principal leeward heat exchange region (365) to the two mutually different heat exchange sections (336*a*-336*f*) of the downstream principal windward heat exchange region (335). This allows for easy provision of the configuration in which the downstream principal windward heat exchange region (335) has more heat exchange sections than the upstream principal leeward heat exchange region (365) when the outdoor heat exchanger (23) functions as an evaporator.

When the outdoor heat exchanger (23) functions as an evaporator, the lower the position of the heat exchange section (336*a*, 338*a*, 366*a*, 368*a*) is in each of the heat exchange regions (335, 337, 365, 367), the more easily the liquid refrigerant flows into that heat exchange section. On the other hand, the height of the communicating space increases as the number of the flat tubes (31) communicating with the communicating space increases. Thus, the drift of the refrigerant occurs more easily in a communicating space communicating with a large number of flat tubes (31) than in a communicating space communicating with a small number of flat tubes (31) when the outdoor heat exchanger (23) functions as an evaporator.

Thus, in the outdoor heat exchanger (23) of the third embodiment, if the plurality of heat exchange sections (336*a*-336*f*, 366*a*-366*c*) of the heat exchange region (335, 365) have different numbers of flat tubes (31), the heat exchange section (336*a*, 366*a*) having a larger number of flat tubes (31) and thus causing the drift of the refrigerant easily in the corresponding communicating space (346*a*, 372*a*) when the outdoor heat exchanger (23) functions as an evaporator is arranged at a lower position to which a large amount of liquid refrigerant flows more easily. As a result, the drift of the refrigerant in the communicating space (346*a*, 372*a*) is reducible because a large amount of liquid refrigerant flows into the communicating space (346*a*, 372*a*) corresponding to the heat exchange section (336*a*, 366*a*) where the drift of the refrigerant occurs easily when the outdoor heat exchanger (23) functions as an evaporator. This allows the outdoor heat exchanger (23) to exhibit sufficiently good performance.

The outdoor heat exchanger (23) of the third embodiment is configured such that the number of the auxiliary windward heat exchange sections (338*a*-338*c*) in the auxiliary windward heat exchange region (337), the number of the auxiliary leeward heat exchange sections (368*a*-368*c*) in the auxiliary leeward heat exchange region (367) and the number of the principal leeward heat exchange sections (366*a*-366*c*) in the principal leeward heat exchange region (365) are equal to each other. However, the outdoor heat exchanger (23) of the third embodiment may be configured such that the number of the heat exchange sections gradually increases from the most upstream heat exchange region toward the most downstream heat exchange region when the outdoor heat exchanger (23) functions as an evaporator. For example, the auxiliary windward heat exchange region (337) may be divided into two auxiliary windward heat exchange sections, each of the auxiliary leeward heat exchange region (367) and the principal leeward heat exchange region (365) may be divided into four heat exchange sections (four auxiliary leeward heat exchange sections and four principal leeward heat exchange sections), and the principal windward heat exchange region (335) may be divided into eight principal windward heat exchange sections. When the outdoor heat exchanger (23) functions as an evaporator, the drift of the refrigerant occurs more easily in the more downstream heat exchange region (335). However, in this configuration, the number of communicating spaces gradually increases from the most upstream heat exchange region (337) toward the most downstream heat exchange region (335). Thus, the drift of the refrigerant flowing from each of the communicating spaces to the flat tubes (31) is effectively reducible. This allows the outdoor heat exchanger (23) to exhibit sufficiently good performance.

Further, the outdoor heat exchanger (23) of the third embodiment includes the two heat exchanger units (30). As a result, the total number of the flat tubes (31) is significantly larger than that in the outdoor heat exchanger (23) of the first embodiment. This allows for increasing a heat exchange capacity as compared with the outdoor heat exchanger (23) of the first embodiment.

In order to increase the heat exchange capacity by increasing the total number of the flat tubes (31) as can be seen in the foregoing description, the total number of the flat tubes (31) in a single heat exchanger unit (30) may be increased in place of increasing the number of the heat exchanger units (30). However, the height of the outdoor heat exchanger (23) may be limited to a certain level depending on the location of the outdoor heat exchanger (23). Thus, in such a case, the height of the outdoor heat exchanger (23) is reducible by providing a plurality of heat exchanger units (30) so as to increase the total number of the flat tubes (31) just like in the third embodiment in place of increasing the total number of the flat tubes (31) in a single heat exchanger unit (30).

Other Embodiments

The outdoor heat exchanger (23) according to the above-described embodiments has been configured such that in two heat exchange regions (35, 37) (135, 235) (335, 365) connected to each other when the outdoor heat exchanger (23) functions as an evaporator, a downstream one of the heat exchange regions having more heat exchange sections than an upstream one, the downstream heat exchange region (35) (135) (335) has twice as many heat exchange sections as those of the upstream heat exchange region (37) (235) (365). However, the configuration in which the downstream heat exchange region has more heat exchange sections than the upstream heat exchange region when the outdoor heat exchanger (23) functions as an evaporator may be achieved in different ways. For example, the outdoor heat exchanger (23) may be configured such that the downstream heat exchange region (35) (135) (335) has at least three times as many heat exchange sections as those of the upstream heat exchange region (37) (235) (365). In such a case, for example, connecting branch pipes (110, 120, 130) each having at least three branched portions may be used.

Further, the outdoor heat exchanger (23) of the above-described embodiments has been configured such that the downstream heat exchange region (35) (135) (335) has more heat exchange sections than the upstream heat exchange region (37) (235) (365) when the outdoor heat exchanger (23) functions as an evaporator by connecting the two heat exchange regions (35, 37) (135, 235) (335, 365) by the branch pipes (connecting branch pipes (110, 120, 130)). However, the configuration in which the downstream heat exchange region has more heat exchange sections than the upstream heat exchange region when the outdoor heat exchanger (23) functions as an evaporator may be achieved in different ways. For example, a distributing structure may be provided in each of the communicating spaces without using the branch pipes.

In the outdoor heat exchanger (23) of the above-described embodiments, the plate-shaped fins (32) may be replaced with wavy fins. These fins are so-called corrugated fins, and have a wavy form which is serpentine in the vertical direction. Each of the wavy fins is arranged between the flat tubes (31) adjacent to each other in the vertical direction.

INDUSTRIAL APPLICABILITY

As can be seen from the foregoing description, the present invention is useful for a heat exchanger which includes flat tubes and fins and allows a refrigerant an air to exchange heat.

DESCRIPTION OF REFERENCE CHARACTERS

10 Air Conditioner
20 Refrigerant Circuit
23 Outdoor Heat Exchanger (Heat Exchanger)
30 Heat Exchanger Unit
31 Flat Tube
32 Fin
35 Principal Heat Exchange Region (Heat Exchange Region)
36*a*-36*f* First to Sixth Principal Heat Exchange Sections (Heat Exchange Sections)
37 Auxiliary Heat Exchange Region (Heat Exchange Region)
38*a*-38*c* First to Third Auxiliary Heat Exchange Sections (Heat Exchange Sections)
40 First Header Collection Pipe
70 Second Header Collection Pipe
75*a*-75*f* First to Sixth Principal Communicating Spaces (Communicating Spaces)
77*a*-77*c* First to Third Auxiliary Communicating Spaces (Communicating Spaces)
110, 120, 130 First, Second and Third Connecting Branch Pipes (Branch Pipes)
135 Upper Principal Heat Exchange Region (Heat Exchange Region)
136*a*-136*f* First to Sixth Upper Principal Heat Exchange Sections (Heat Exchange Sections)
142*a*-142*f* First to Sixth Upper Principal Communicating Spaces (Communicating Spaces)
143*a*-143*c* First to Third Lower Principal Communicating Spaces (Communicating Spaces)
173*a*-173*c* First to Third Lower Principal Communicating Spaces (Communicating Spaces)
235 Lower Principal Heat Exchange Region (Heat Exchange Region)
236*a*-236*c* First to Third Lower Principal Heat Exchange Sections (Heat Exchange Sections)
335 Principal Windward Heat Exchange Region (Heat Exchange Region)
336*a*-336*f* First to Six Principal Windward Heat Exchange Sections (Heat Exchange Sections)

337 Auxiliary Windward Heat Exchange Region (Heat Exchange Region)

338*a*-338*c* First to Third Auxiliary Windward Heat Exchange Sections (Heat Exchange Sections)

340 First Windward Header Collection Pipe (First Header Collection Pipe)

345 Second Windward Header Collection Pipe (Second Header Collection Pipe)

346*a*-346*f* First to Sixth Principal Communicating Spaces (Communicating Spaces)

347*a*-347*c* First to Third Auxiliary Communicating Spaces (Communicating Spaces)

365 Principal Leeward Heat Exchange Region (Heat Exchange Region)

366*a*-366*c* First to Third Principal Leeward Heat Exchange Sections (Heat Exchange Sections)

367 Auxiliary Leeward Heat Exchange Region (Heat Exchange Region)

368*a*-368*c* First to Third Auxiliary Leeward Heat Exchange Sections (Heat Exchange Sections)

370 First Leeward Header Collection Pipe (First Header Collection Pipe)

372*a*-372*c* First to Third Principal Communicating Spaces (Communicating Spaces)

373*a*-373*c* First to Third Auxiliary Communicating Spaces (Communicating Spaces)

380 Second Leeward Header Collection Pipe (Second Header Collection Pipe)

382*a*-382*c* First to Third Principal Communicating Spaces (Communicating Spaces)

383*a*-383*c* First to Third Auxiliary Communicating Spaces (Communicating Spaces)

The invention claimed is:

1. A heat exchanger comprising:

at least one heat exchanger unit including a plurality of vertically arranged flat tubes, fins joined to the flat tubes, a first header collection pipe connected to one end of each of the plurality of flat tubes, and a second header collection pipe connected to the other end of each of the plurality of flat tubes, the heat exchanger unit being divided into a plurality of vertically arranged heat exchange regions, and the plurality of heat exchange regions being connected in series when the heat exchanger functions as an evaporator, the heat exchanger allowing a refrigerant flowing through the plurality of flat tubes and air to exchange heat, wherein each of the heat exchange regions is further divided into a plurality of vertically arranged heat exchange sections in which flows of the refrigerant run in the same direction, each heat exchange section including two or more of the plurality of flat tubes, communicating spaces each communicating with the two or more of the plurality of flat tubes are formed in each of the first and second header collection pipes in a one-to-one relationship with the heat exchange sections, partition plates are arranged in each of the first and second header collection pipes to partition each communicating space, which is located upstream of an associated one of the heat exchange sections when the heat exchanger functions as an evaporator, from other vertically adjacent communicating space, when the heat exchanger functions as an evaporator, a most upstream one of the heat exchange regions has less flat tubes in each heat exchange section than the flat tubes in each heat exchange section of a most downstream one of the heat exchange regions, in two of the heat exchange regions connected to each other when the heat exchanger functions as an evaporator, a downstream one of the heat exchange regions has the heat exchange sections not less than the heat exchange sections of an upstream one of the heat exchange regions, and a most downstream one of the heat exchange regions has more heat exchange sections than a most upstream one of the heat exchange regions, in two of the heat exchange regions connected to each other when the heat exchanger functions as the evaporator, the communicating spaces of the heat exchange sections of the upstream one of the heat exchange regions are respectively connected to different communicating spaces, or different sets of two or more communicating spaces, of the heat exchange sections of the downstream one of the heat exchange regions, and the heat exchange section having the largest number of the flat tubes is arranged at a lowest position in each of the heat exchange regions.

2. The heat exchanger of claim 1, wherein when the heat exchanger functions as an evaporator, the number of the heat exchange sections of each of the heat exchange regions gradually increases from the most upstream heat exchange region toward the most downstream heat exchange region.

3. The heat exchanger of claim 1, wherein in two of the heat exchange regions connected to each other when the heat exchanger functions as an evaporator, a downstream one of the heat exchange regions having more heat exchange sections than an upstream one, the number of the heat exchange sections of the downstream heat exchange region is a multiple of the number of the heat exchange sections of the upstream heat exchange region.

4. The heat exchanger of claim 3, wherein between two of the heat exchange regions connected to each other when the heat exchanger functions as an evaporator, a downstream one of the heat exchange regions having more heat exchange sections than an upstream one, a branch pipe is provided to connect each of the heat exchange sections of the upstream heat exchange region to the plurality of mutually different heat exchange sections of the downstream heat exchange region.

5. The heat exchanger of claim 1, wherein the heat exchanger unit includes a plurality of heat exchanger units, and all the heat exchange regions of the plurality of heat exchanger units are connected in series when the heat exchanger functions as an evaporator.

6. An air conditioner comprising:

a refrigerant circuit including the heat exchanger of claim 1, wherein a refrigerant is circulated in the refrigerant circuit to perform a refrigeration cycle.

7. The heat exchanger of claim 2, wherein in two of the heat exchange regions connected to each other when the heat exchanger functions as an evaporator, a downstream one of the heat exchange regions having more heat exchange sections than an upstream one, the number of the heat exchange sections of the downstream heat exchange region is a multiple of the number of the heat exchange sections of the upstream heat exchange region.

8. The heat exchanger of claim 7, wherein between two of the heat exchange regions connected to each other when the heat exchanger functions as an evaporator, a downstream one of the heat exchange regions having more heat exchange sections than an upstream one, a branch pipe is provided to connect each of the heat exchange sections of the upstream heat exchange region to the plurality of mutually different heat exchange sections of the downstream heat exchange region.

9. A heat exchanger comprising:

at least one heat exchanger unit including a plurality of vertically arranged flat tubes, fins joined to the flat tubes, and a header collection pipe connected to an end of each of the plurality of flat tubes, the heat exchanger unit being divided into a plurality of vertically arranged heat exchange regions, and the plurality of heat exchange regions being connected in series when the heat exchanger functions as an evaporator, the heat exchanger allowing a refrigerant flowing through the plurality of flat tubes and air to exchange heat, wherein each of the heat exchange regions is further divided into a plurality of vertically arranged heat exchange sections in which flows of the refrigerant run in the same direction, each heat exchange section including two or more of the plurality of flat tubes, communicating spaces each communicating with the two or more of the plurality of flat tubes are formed in the header collection pipe in a one-to-one relationship with the heat exchange sections, when the heat exchanger functions as an evaporator, a most upstream one of the heat exchange regions has less flat tubes in each heat exchange section than the flat tubes in each heat exchange section of a most downstream one of the heat exchange regions, partition plates are arranged in the header collection pipe to partition each communicating space, which is located upstream of an associated one of the heat exchange sections when the heat exchanger functions as an evaporator, from other vertically adjacent communicating space, in two of the heat exchange regions connected to each other when the heat exchanger functions as an evaporator, a downstream one of the heat exchange regions has the heat exchange sections not less than the heat exchange sections of an upstream one of the heat exchange regions, and a most downstream one of the heat exchange regions has more heat exchange sections than a most upstream one of the heat exchange regions, in two of the heat exchange regions connected to each other when the heat exchanger functions as the evaporator, the communicating spaces of the heat exchange sections of the upstream one of the heat exchange regions are respectively connected to different communicating spaces, or different sets of two or more communicating spaces, of the heat exchange sections of the downstream one of the heat exchange regions, the heat exchange section having the largest number of the flat tubes is arranged at a lowest position in each of the heat exchange regions.

10. An air conditioner comprising:

a refrigerant circuit including the heat exchanger of claim 9, wherein a refrigerant is circulated in the refrigerant circuit to perform a refrigeration cycle.

* * * * *